US007362064B2

(12) United States Patent
Coates et al.

(10) Patent No.: US 7,362,064 B2
(45) Date of Patent: Apr. 22, 2008

(54) CONTROL ARRANGEMENT FOR A CLEANING APPLIANCE

(76) Inventors: Donald A. Coates, 5045 Hollyhock Ave., NW., Canton, OH (US) 44718; Robert W. Bauman, 1112 Linwood Ave., SW., North Canton, OH (US) 44720; Michael A. Durbin, 3487 Dovershire Ave., NW., Massillon, OH (US) 44646; Evan A. Gordon, 1655 Bexwell St., NE., Canton, OH (US) 44714; Adam C. Sclafani, 417 Winston Ave., NE., North Canton, OH (US) 44720; Aaron P. Tondra, 8081 Rolling Hill, NW., North Canton, OH (US) 44720; William H. Theiss, Jr., 3914 Ennis Cir., NE., Canton, OH (US) 44705; Timothy T. Hertrick, 8338 Turquoise NE., Canton, OH (US) 44721; David A. Bradshaw, 4730 - 20th St. NW., Canton, OH (US) 44708; Edgar A. Maurer, 819 - 14th St. NW., Canton, OH (US) 44703; Wilbur J. Kellum, 211 Hillcrest Ave. NW., North Canton, OH (US) 44720

( * ) Notice: Subject to any disclaimer, the term of this patent is extended or adjusted under 35 U.S.C. 154(b) by 153 days.

(21) Appl. No.: 10/941,393

(22) Filed: Sep. 15, 2004

(65) Prior Publication Data

US 2005/0029971 A1 Feb. 10, 2005

Related U.S. Application Data

(60) Division of application No. 10/145,352, filed on May 13, 2002, now Pat. No. 7,146,679, which is a continuation-in-part of application No. 09/861,956, filed on May 21, 2001, now Pat. No. 6,681,442.

(51) Int. Cl.

| | |
|---|---|
| ***H02P 1/00*** | (2006.01) |
| ***H02P 3/00*** | (2006.01) |
| ***A47L 9/00*** | (2006.01) |
| ***A47L 11/20*** | (2006.01) |

(52) U.S. Cl. ..... 318/286; 318/280; 318/282; 15/319; 15/320; 15/340.1; 15/340.2

(58) Field of Classification Search ..... 318/5, 318/7, 8, 19, 34–36, 9, 280–286; 15/300–340, 15/340.1, 340.2

See application file for complete search history.

(56) References Cited

U.S. PATENT DOCUMENTS

| | | | | |
|---|---|---|---|---|
| 4,245,370 | A * | 1/1981 | Baker | 15/319 |
| 4,357,729 | A * | 11/1982 | Vander Molen et al. | 15/319 |
| 4,370,690 | A * | 1/1983 | Baker | 361/23 |
| 4,637,092 | A * | 1/1987 | Hayashi et al. | 15/319 |
| 4,654,924 | A * | 4/1987 | Getz et al. | 15/319 |

(Continued)

FOREIGN PATENT DOCUMENTS

| | | |
|---|---|---|
| GB | 2240595 A | 7/1991 |

*Primary Examiner*—Paul Ip

(57) ABSTRACT

A cleaner for cleaning a surface comprises a floor-engaging portion for moving along the surface. A magnet and a hall effect sensor located in the cleaner handle generates a control signal. The control signal is provided to a control circuit which controls one or more operational features of the cleaner. One such operational features includes at least one pump for mixing and distributing cleaning solution to the surface. In an alternate embodiment, the control circuit controls an electric motor for propelling the cleaner over the surface.

11 Claims, 27 Drawing Sheets

U.S. PATENT DOCUMENTS 4,728,942 A * 3/1988 England ..... 340/679
5,044,043 A 9/1991 Basham et al.
5,789,884 A 8/1998 Hancock
5,815,881 A * 10/1998 Sjogreen ..... 15/321
5,881,430 A * 3/1999 Driessen et al. ..... 15/319
6,061,869 A * 5/2000 Ettes et al. ..... 15/340.2
6,131,236 A * 10/2000 Roth ..... 15/319
6,457,205 B1 * 10/2002 Conrad ..... 15/319
6,681,442 B2 * 1/2004 Coates et al. ..... 15/320
7,000,285 B2 * 2/2006 Conner et al. ..... 15/319
7,043,794 B2 * 5/2006 Conner et al. ..... 15/340.2
7,146,679 B2 * 12/2006 Coates et al. ..... 15/319
7,222,390 B2 * 5/2007 Cipolla et al. ..... 15/340.2
2004/0134018 A1 7/2004 Conner et al.
2004/0135537 A1 7/2004 Conner et al.

* cited by examiner

CONTROL ARRANGEMENT FOR A CLEANING APPLIANCE

CROSS REFERENCE TO RELATED APPLICATIONS

This application is a divisional application of U.S. Ser. No. 10/145,352 filed on May 13, 2002 now U.S. Pat. No. 7,146,679 which is a continuation-in-part of application Ser. No. 09/861,956, filed May 21, 2001 which has issued as U.S. Pat. No. 6,681,442.

BACKGROUND OF THE INVENTION

1. Field of the Invention

The present invention relates to an apparatus and method for cleaning a surface. More particularly, the present application pertains to a carpet extractor that can clean the carpet using one cleaning mode on the forward stroke of a cleaning cycle and then clean the carpet using another cleaning mode on the reverse stroke of a cleaning cycle without an extra operation.

2. Background Information

It is known in the prior art to provide a carpet extractor in which cleaning solution is dispensed to a carpeted surface and substantially simultaneously extracted along with the dirt on the carpet in a continuous operation. For example, U.S. Pat. No. 5,500,977 issued to McAllise et al. discloses such a carpet extractor. Specifically, as depicted in FIG. 8B of this patent, when extractor 10 is operated in the floor cleaning mode to clean the carpet, cleaning solution, upon the operator's command, is discharged from the cleaning fluid supply tank 40, passing through the supply line 328, and into the fluid distributor 650 positioned within air discharge nozzle 65 whereby the cleaning fluid is atomizingly distributed throughout the discharged air and conveyed thereby to the carpet being cleaned. Simultaneously, working air, including cleaning fluid and dirt from the carpet, is drawn into floor nozzle 70, through floor conversion module 526, air/fluid separator lid 55 and into the recovery tank 510. Warm, moist exhaust air, from motor fan 610, is discharged through discharge nozzle 65 and directed toward the surface being cleaned. Thus, the upright carpet extractor applies and/or extracts the cleaning solution on the both the forward and reverse stroke.

Usually for this type of extractor, the detergent concentration in the cleaning solution is not at a high amount that will leave a white detergent residue on the carpet from the dried cleaning solution not extracted. Such a residue conditions the carpet to create a high potential for dirt to deposit on the carpet. Yet, it may be desirable to use such a high amount of detergent concentration on the carpet on either the reverse or forward stroke, for example, to clean it when it is very dirty or soiled.

It is known that some of these carpet extractors have a variable mixing valve to permit varying the water/detergent mixture ratios to accommodate a wide variety of cleaning situations. One such cleaner is illustrated by U.S. Pat. No. 5,937,475 issued to Kasen. This valve is manually controlled by a knob provided on the outside of an upper housing pivotally mounted to the base assembly. However, during operation of the extractor, a user must stop cleaning to move to a position to operate the knob if he wants to change the water/detergent mixture ratio for a different cleaning situation. This proves to be quite inconvenient for the user, especially if, for example, a user wants to apply cleaning fluid on the forward stroke to wash the carpet and clean water on the reverse stroke to rinse the carpet. In addition to operation of the knob, activation of a button, lever or other switching device on the handle to apply the cleaning solution to the carpet requires another operation by a user as he or she moves the suction cleaner along the floor to clean it.

Hence, it is an object of the present invention to provide a convenient, ergonomically design apparatus on a carpet extractor that can clean the carpet or floor using one cleaning mode on the forward stroke of a cleaning cycle and another cleaning mode for the reverse stroke of the cleaning cycle.

It is another object of the present invention to provide a method of cleaning a carpet or floor using one cleaning mode on the forward stroke of a cleaning cycle and another cleaning mode on the reverse stroke of the cleaning cycle.

It is another object of the present invention to provide an apparatus on a carpet extractor that selects a cleaning cycle to clean the carpet or floor.

It is another object of the present invention to provide an apparatus and method on a carpet extractor that improves the cleaning performance.

SUMMARY OF THE INVENTION

The foregoing and other objects of the present invention will be readily apparent from the following description and the attached drawings. In one embodiment of the present invention, a cleaner for cleaning a surface comprises a floor-engaging portion for moving along the surface. A source supplies a liquid to a distributor, which distributes the liquid from the source onto the surface. An activating device operatively connected to the source activates the source to supply liquid to the distributor to distribute liquid on the surface in response to a force moving the floor-engaging portion in a first direction.

BRIEF DESCRIPTION OF THE DRAWINGS

The invention will now be described, by way of example, with reference to the attached drawings, of which.

DETAILED DESCRIPTION OF THE INVENTION

Figure 1:
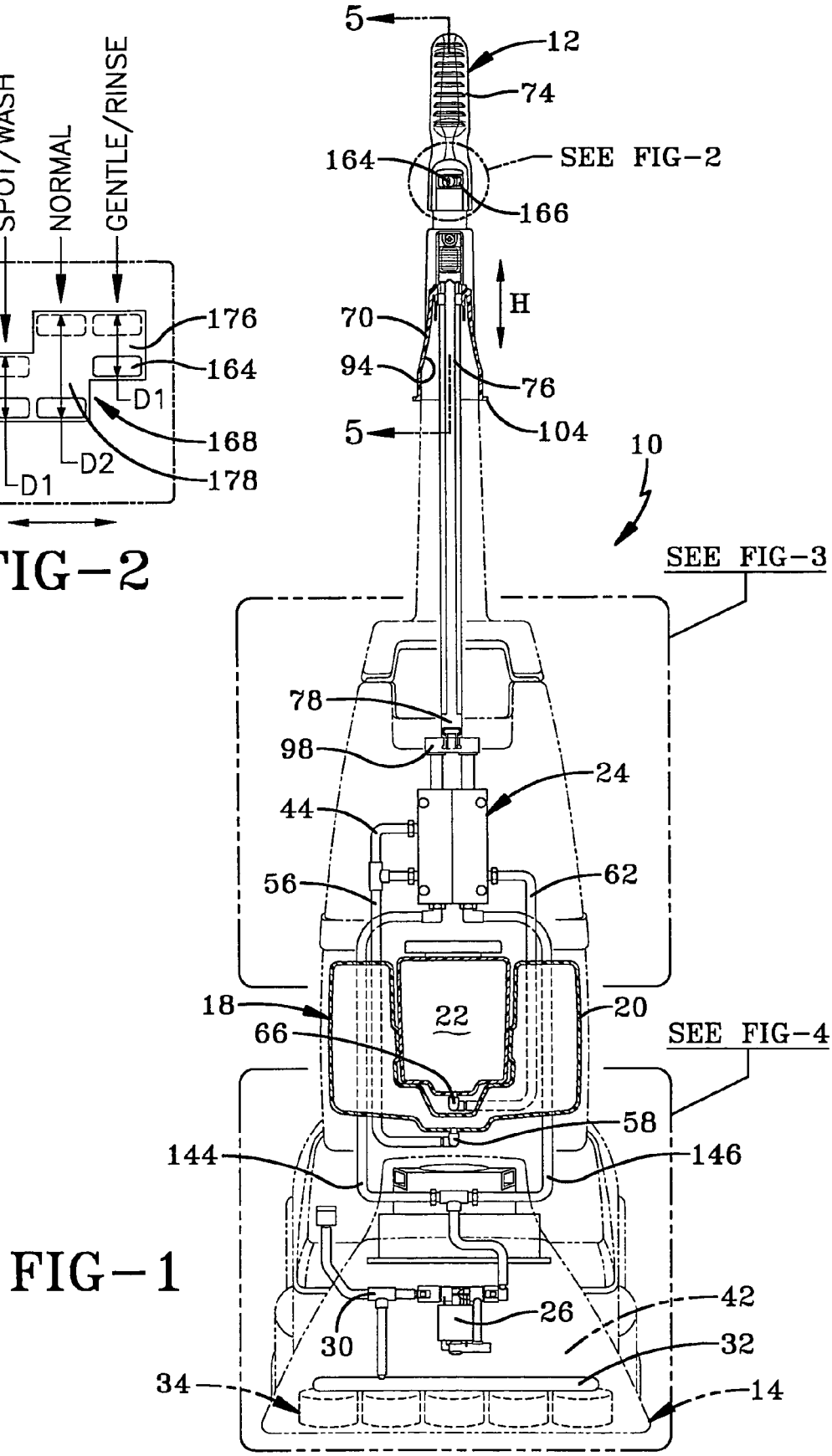
FIG. 1 is a diagrammatic partial, front sectional view of a carpet extractor incorporating a fluid distribution system according to the present invention.

In one embodiment of the present invention, a fluid supply system is provided in an upright style carpet extractor 10 as diagrammatically illustrated in FIG. 1. The upright carpet extractor 10 includes a pivotal handle portion 12 for propelling a floor-engaging portion or foot 14 over a carpeted floor. The floor-engaging portion 14 includes a brush assembly 34 having a plurality of rotating scrub brushes 16 (FIG. 4) for scrubbing the floor. A supply tank assembly 18 is mounted to the floor-engaging portion 14 of the extractor. The supply tank assembly 18 comprises a clean water supply tank 20 and a detergent supply tank 22, which nests into an open area formed by surrounding portions of the clean water tank 20. It should be noted that the supply tanks 20, 22 could alternatively be located adjacent one another in a side-by-side relationship. The clean water and detergent are drawn from their respective tanks 20, 22 to a valve assembly 24 through operation of a pump 26. The cleaning liquid comprising the detergent and/or clean water from the valve assembly 24 travels to the pump 26.

Figure 4:
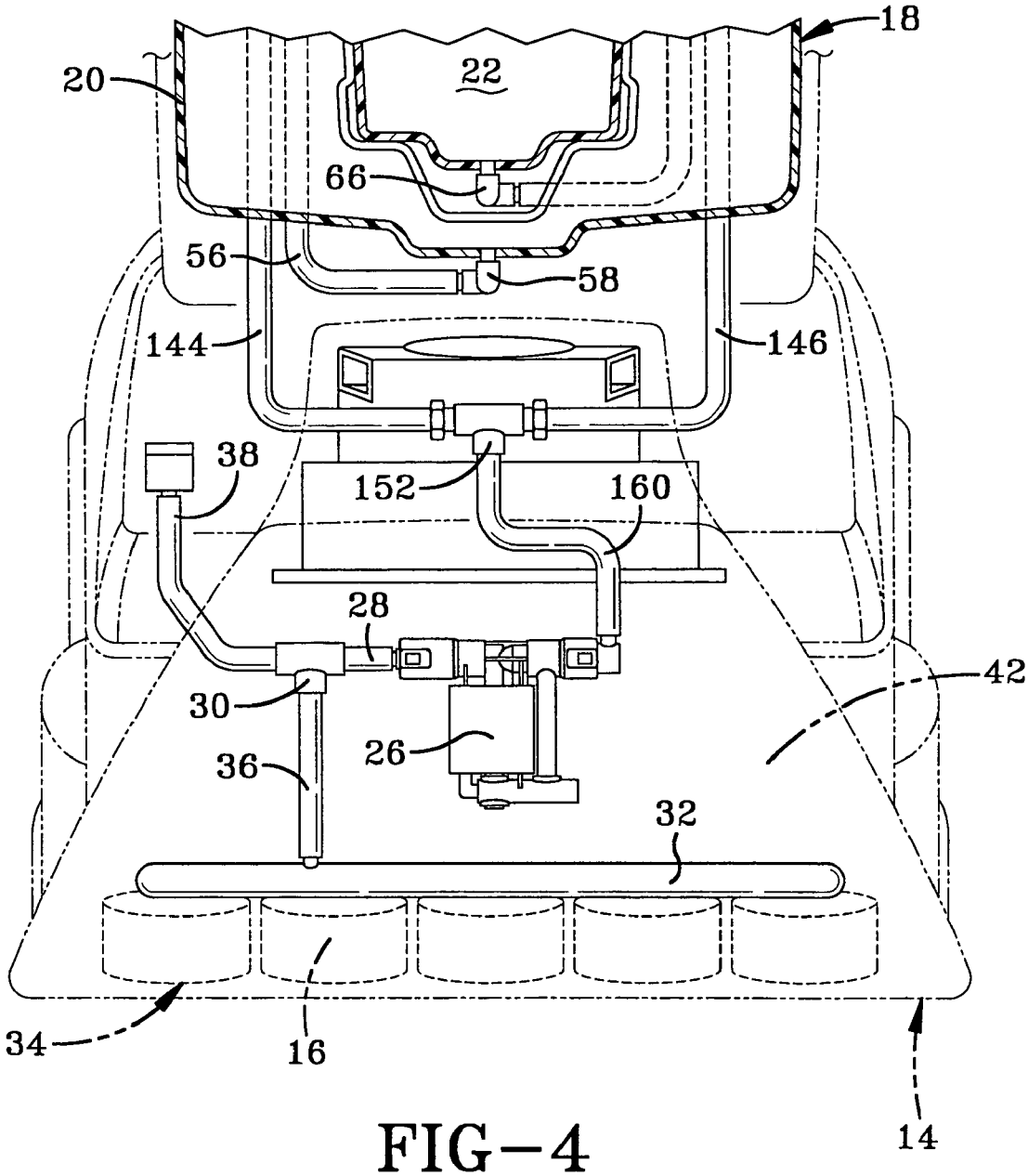
FIG. 4 is an enlarge view of the floor-engaging portion of FIG. 1.

Referring to FIG. 4, the pump 26 conducts the pressurized cleaning solution or clean water through a main supply tube 28 to a control valve 30 which selectively allows the liquid to flow to either a cleaning distributor 32 provided on a brush assembly 34 via a supply tube 36 or a hand-held cleaning attachment (not shown) via a supply tube 38. The cleaning liquid distributor 32 evenly distributes the cleaning liquid to each of the rotary scrub brushes 16. The scrub brushes 16 then spread the cleaning liquid onto the carpet (or bare floor), scrub the cleaning liquid into the carpet and dislodge embedded soil. Such a distributor 32 and scrub brushes 16 are substantially disclosed in commonly owned U.S. Pat. No. 5,867,857, the disclosure of which is hereby incorporated herein as of reference.

As is commonly known, the carpet extractor 10 distributes cleaning solution to the carpeted surface and substantially simultaneously extracts it along with the dirt on the carpet in a continuous operation. In particular, soiled cleaning liquid is extracted from the carpet by a suction nozzle 42, which communicates with a recovery tank 219 (FIG. 10) via an air duct. A vacuum is created in the recovery tank by a motor fan assembly (not shown) that draws air from the recovery tank and exhausts the air to the external atmosphere in a well-known, conventional manner. The recovery tank includes an air and liquid separator (not shown), as is understood by one of skill in the art, for separating liquid from the air entering the recovery tank and recovering the separated liquid in the tank. A suitable upright carpet extractor is disclosed in co-owned U.S. Pat. No. 5,500,977, the disclosure of which is hereby incorporated herein as of reference.

Figure 3:
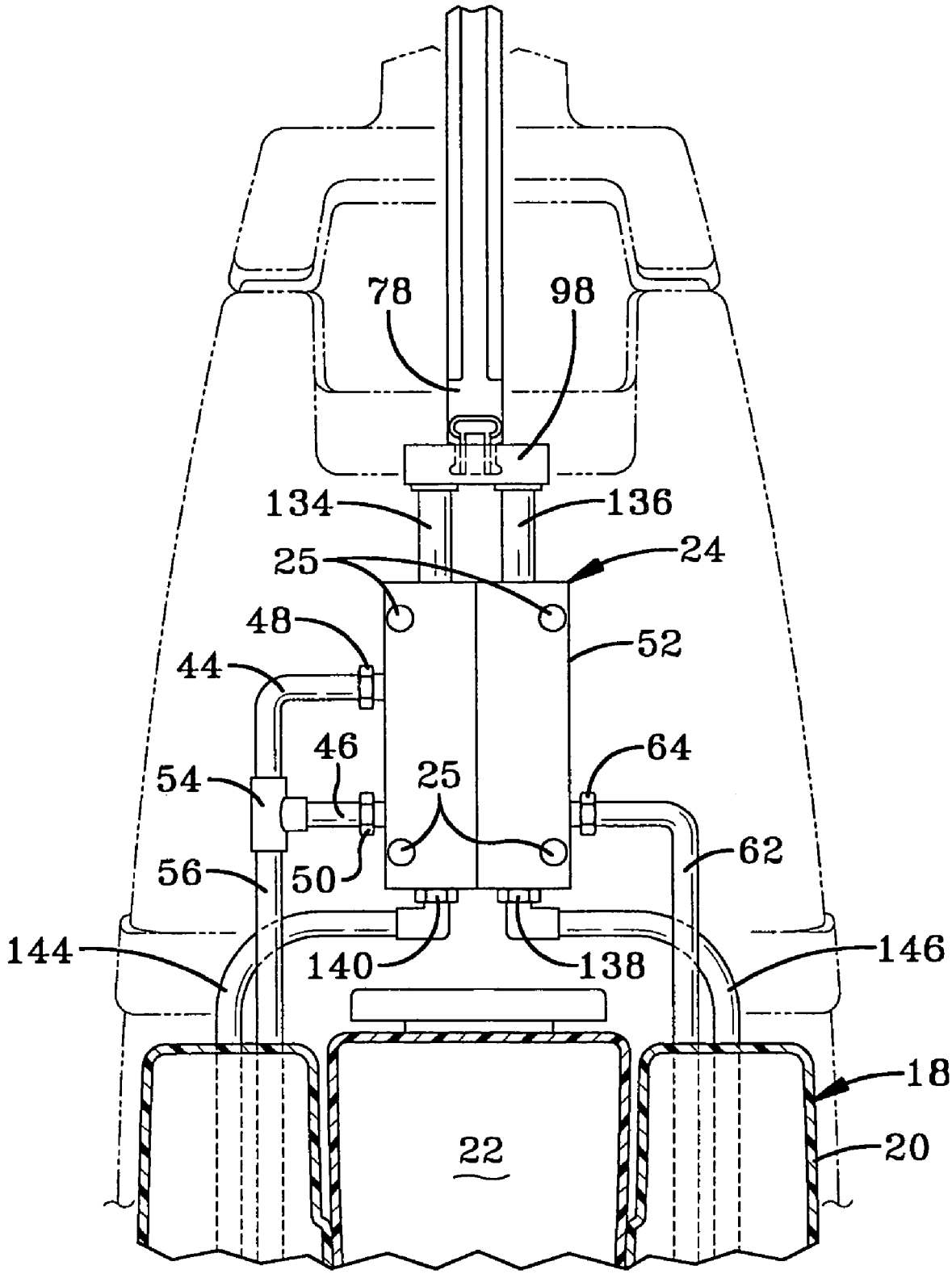
FIG. 3 is an enlarge view of the valve assembly shown in FIG. 1.

Referring to FIG. 3, the clean water supply tank 20 fluidly communicates with the valve assembly 24 via upper and lower water supply tubes 44, 46 connected to respective upper and lower water lateral inlets 48, 50 of a valve body 52 of the valve assembly 24. In particular, the upper and lower supply tubes 44, 46 are fluidly connected to a T-fitting 54, which is fluidly connected to a main water supply tube 56. The main water supply tube 56 is fluidly connected to an outlet 58 (FIG. 1) formed in the bottom of the clean water supply tank 20. The detergent supply tank 22 fluidly communicates with the valve assembly 24 via a detergent supply tube 62. Specifically, one end of the detergent supply tube 62 is connected to a lateral inlet 64 in the valve body 52 and the other end is connected to an outlet 66 (FIG. 1) formed in the bottom of the detergent supply tank 22.

Figure 5:
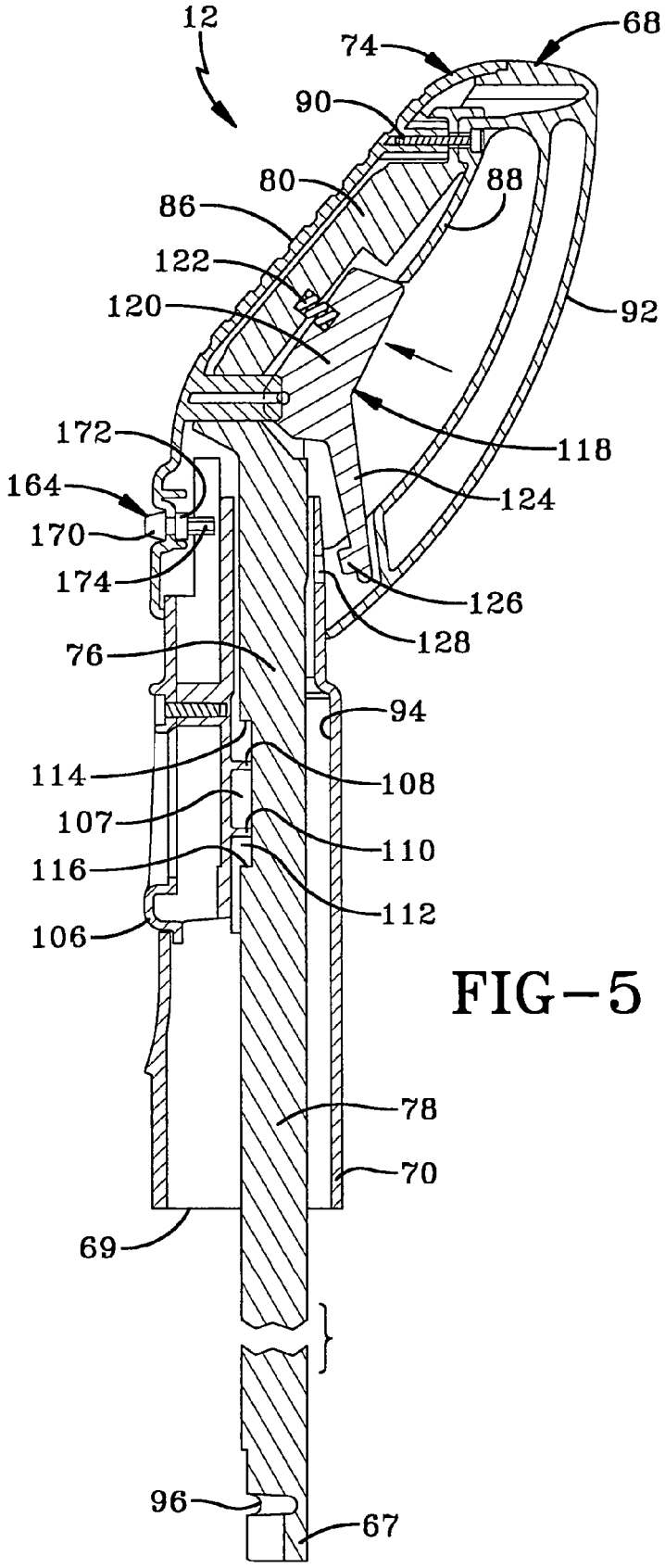
FIG. 5 is a sectional view as taken along line 5-5 in FIG. 1 showing the grip rod being unlock from the handle by the trigger control lever.
Figure 6:
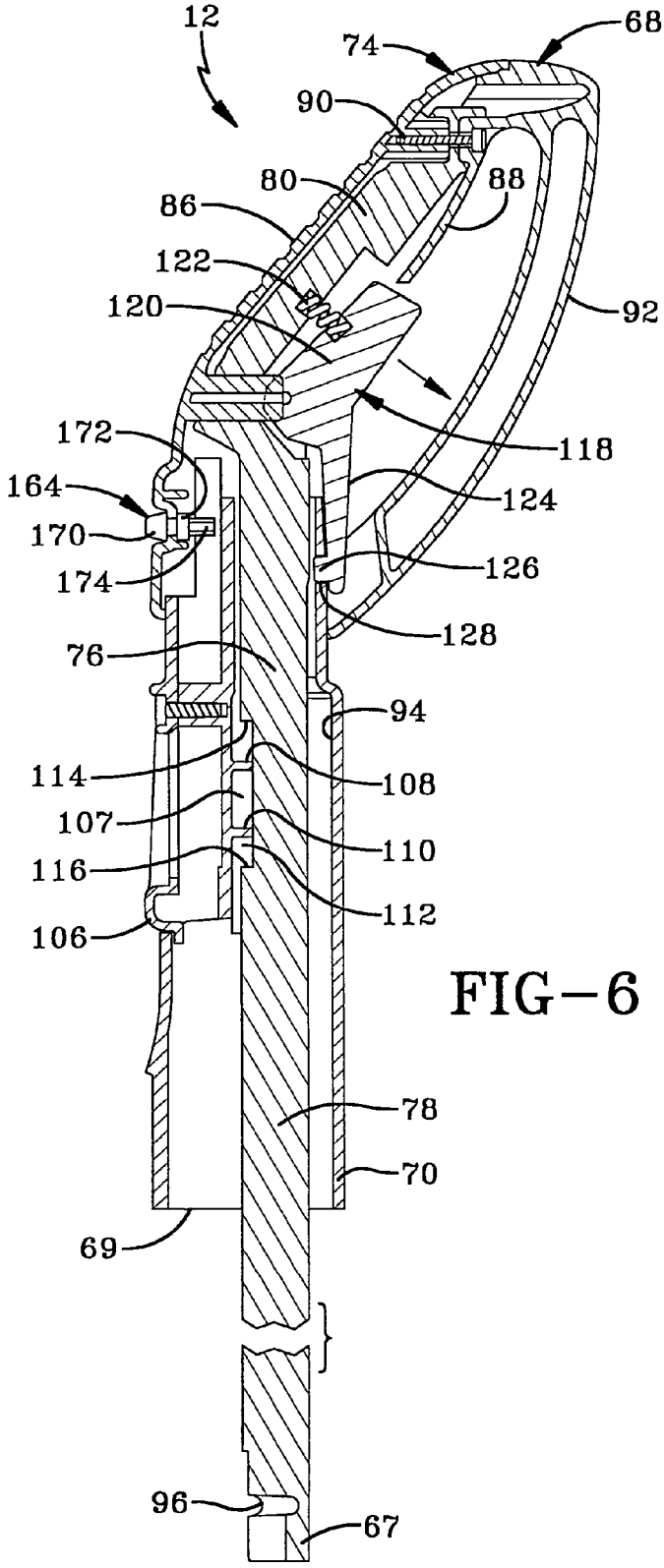
FIG. 6 is a sectional view taken along line 5-5 in FIG. 1 with the grip rod being locked by the trigger control lever.

As shown in FIG. 1, a hand grip 74 is slidably mounted to a handle stem 70 that is fixedly attached to the handle 12 for limited reciprocal motion relative to the handle stem 70 as illustrated by arrow H. As depicted in FIGS. 5 and 6, the upper handle assembly 68 includes the handgrip 74 that is mounted to the top of the handle stem 70 for limited rectilinear reciprocal motion relative to the handle stem 70. The handgrip 74 includes a grip rod 76 having a lower stem portion 78 and an upper grip portion 80 that is located at an angle relative to the lower stem portion 78. A front grip half 86 and a rear grip half 88 are sandwiched about the grip portion 80 of the grip rod 76 and snapped together. A screw 90 is passed through the rear grip half 88, through the grip portion 80 of the grip rod 76, and is threaded into the front grip half 86 to secure the grip halves in place upon the grip portion 80 of the grip rod 76. The hand grip 74 has a lower loop portion 92 integrally formed on the rear grip half 88.

With particular reference to FIG. 1, the handle stem 70 is an upwardly tapering hollow tubular member. A top portion of the handle stem 70 has an inner peripheral surface 94 having a centrally located D-shaped cross section, as best seen in FIG. 4 of U.S. Pat. No. 6,108,862; the disclosure of which is incorporated by reference. The lower stem portion 78 of the grip rod 76 also has a D-shaped cross section that is sized to be slidably received within the handle stem 70 as shown in FIGS. 5 and 6. The handgrip 74 is mounted to the top of handle stem 70 by telescopically sliding the stem portion 78 of the grip rod 76 into the top of the handle stem 70 until a lower end 67 of the grip rod 76 extends below a lower end 69 of the handle stem 70.

With continued reference to FIGS. 5 and 6, a forwardly opening notch 96 is located in the lower end of the grip rod 76, below the lower end 69 of the handle stem 70, for snap connection to an engaging member (not shown) of a base 98 (FIG. 1). The D-shaped cross-section of the stem portion 78 of the grip rod 76 and the inner surface 94 of the top portion of the handle stem 70 prevent the hand grip 74 from twisting or rotating about the longitudinal axis of the stem portion 78 of the grip rod 76 relative to the handle stem 70.

The upper handle assembly 68 further includes a stop pocket 106 mounted to the front of the handle stem 70. A vertically extending ridge 107 having upper and lower portions 108, 110, respectively, extends from a rear or inner surface of the stop pocket 106 and is received in a longitudinally extending recess 112 in the stem portion 78 of the grip rod 76. With this construction, upper and lower portions 108, 110 on the rear of the stop pocket 106 engage respective upper and lower extremities 114, 116 of the recess 112 in the grip rod 76, thereby limiting the upward and downward vertical travel of the grip rod 76 and hand grip 74 relative to the handle stem 70.

Thus, when an operator pulls on the hand grip 74, the hand grip 74 moves up relative to the handle stem 70 into a reverse position in which the upper portion 108 contacts the upper extremity 114 of the recess 112 in the grip rod 76. Alternatively, when an operator pushes on the hand grip 74, the hand grip 74 moves down relative to the handle stem 70 into a forward position in which the lower portion 110 contacts the lower extremity 116 of the recess 112 in the grip rod 76.

With continued reference to FIGS. 5 and 6, a control lever 118 is pivotally connected to the grip portion 80 of the grip rod 76. The control lever 118 includes an upper trigger portion 120 and a lower portion 124. A spring 122, attached to the hand grip 74 and upper portion 120, biases the upper trigger portion 120 outwardly in a counter clockwise direction as indicated by the arrow in FIG. 6. The lower portion 124 includes a protrusion 126 near its lower end, which is urged by the spring 122 into a lateral pilot hole 128 formed in the handle stem 70 as depicted in FIG. 6. When the protrusion 126 is inserted into the pilot hole 128, the hand grip 74 is locked to the handle stem 70 and thus cannot reciprocally move. As shown in FIG. 5, the hand grip 74 is unlocked from the handle stem 70, when a force, as indicated by the arrow, is applied to the trigger portion 120, (for example, by a user grasping the hand grip 74 and squeezing the trigger portion 120 inwardly using his index finger), that overcomes the force of the spring 122, which pivotally moves the lower portion 124 of the control lever 118 away from the handle stem 70 and subsequently the protrusion 126 out of the pilot hole 128.

Figure 7C:
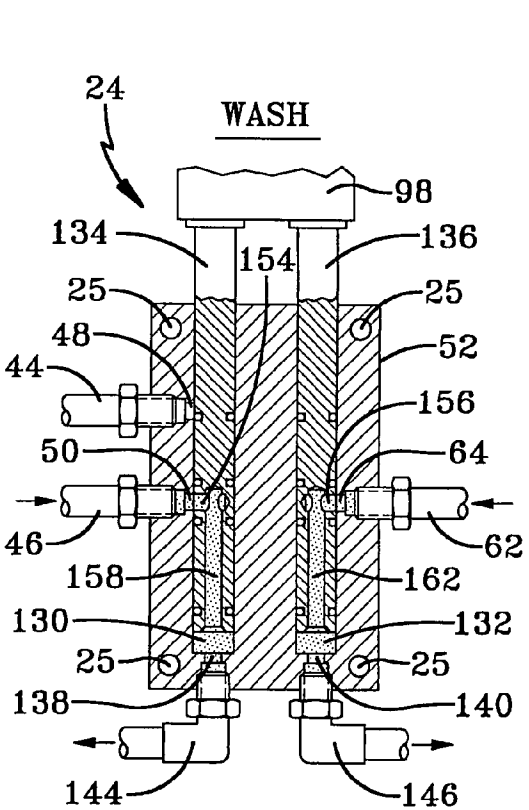
FIG. 7C is a partial, front sectional view of the valve assembly in a position that allows the carpet extractor to operate in the wash cleaning mode.
Figure 7B:
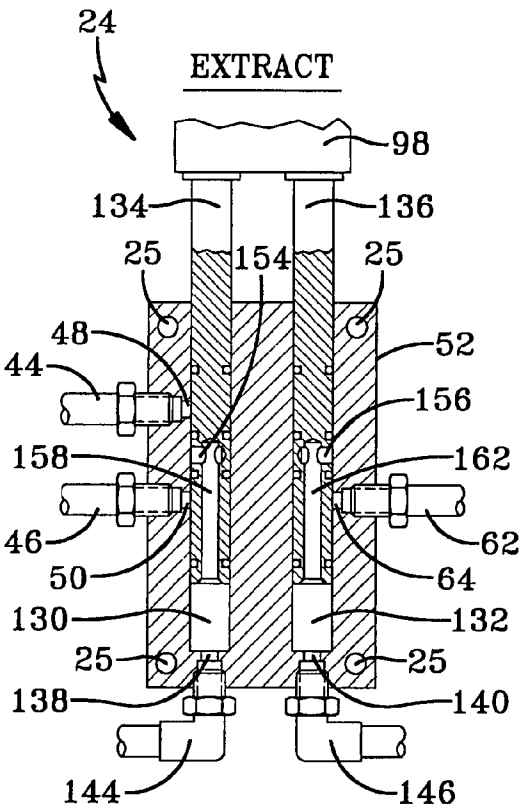
FIG. 7B is a partial, front sectional view of the valve assembly in a position that allows the carpet extractor to operate in the extract only cleaning mode.
Figure 7A:
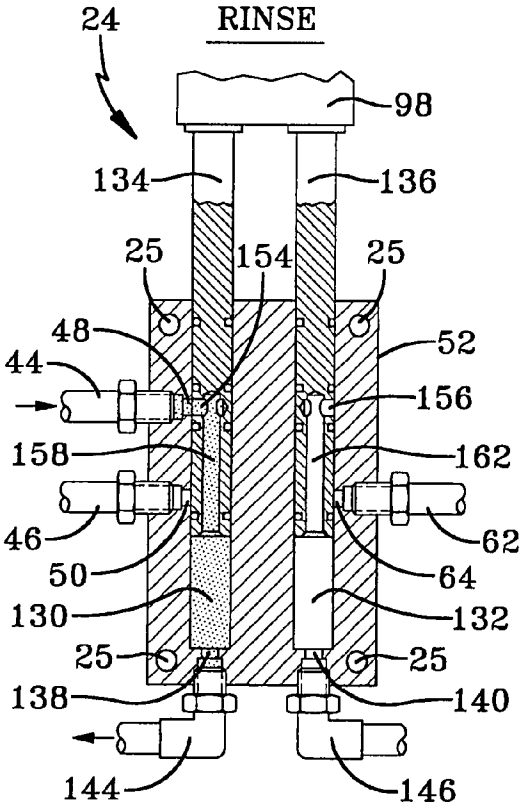
FIG. 7A is a partial, front sectional view of the valve assembly in a position that allows the carpet extractor to operate in the rinse-cleaning mode.

As seen in FIGS. 7A, 7B, and 7C, the valve assembly 24 comprises a valve body 52 having a pair of longitudinal bores 130, 132 for receiving a pair of valve stems 134, 136. The valve stems 134, 136 have respective cylindrically internal passageways 158, 162 formed therein. The valve assembly 24 is mounted to the handle portion 12 (FIG. 1) by bolts 25. A pair of outlets 138, 140 are located on the bottom of the valve body 52 and fluidly communicate with their respective bores 130, 132 and passageways 158, 162 of the valve stems 134, 136. The valve stems 134, 136 are attached to an upper base 98 and extend downwardly there from. The base 98 is secured to the lower portion of the grip rod 76 (FIG. 1) by any suitable means. For example, such means could be a nut and bolt connection or the engaging member (not shown) snap connecting into the notch 96 as previously mentioned. Thus, reciprocal movement of the grip rod 76 will in turn cause reciprocal movement of the valve stems 134, 136 inside the bores 130, 132. As depicted in FIG. 1, supply tubes 144, 146 are connected between their respective outlets 138, 140 (FIGS. 7A, 7B, and 7C) and respective branches of a T-fitting 152. As seen in FIG. 4, the T-fitting 152 is fluidly connected to the pump 26 via a main supply tube 160.

As further depicted in FIGS. 7A, 7B, and 7C, the valve stems 134, 136 include lateral inlets 154, 156, respectively, that have similar diameters as the inlets 48, 50, 64 of the valve body 52. The inlets 154, 156 of the valve stems 134, 136 align with their respective inlets 48, 50, and 64 through selective positioning of the valve stems 134, 136 within the bores 130, 132 for desired cleaning modes. In particular, for the rinse-cleaning mode as depicted in FIG. 7A, the inlet 154 in the valve stem 134 aligns with the upper inlet 48 for the clean water but the inlet 156 in the valve stem 136 is not aligned with the inlet 64 of the valve body 52 for the detergent. Thus, clean water can travel through the passageway 158 in the valve stem 134 and bore 130 of the valve body 52 to the outlet 138 of the valve body 52. As shown in FIG. 4, the clean water would then travel to the pump 26 via the supply tube 144, the T-fitting 152, and main supply tube 160 for delivery to the cleaning distributor 32 or cleaning attachment as previously mentioned. For the wash cleaning mode as depicted in FIG. 7C, the inlet 156 of the valve stem 136 aligns with the inlet 64 of the valve body 52 for the detergent and the inlet 154 of the valve stem 134 aligns with the lower inlet 50 of the valve body 52 for the clean water. Thus, liquid detergent can travel through the passageway 162 in the detergent valve stem 136 and bore 132 of the valve body 52 to the outlet 140 of the valve body 52. As depicted in FIG. 4, the liquid detergent would then travel through the supply tube 146 to the T-fitting 152, where the detergent would be combined with the clean water from the supply tube 144. The combined cleaning solution then would travel to the pump 26 via the main supply tube 160 for delivery to the cleaning distributor 32 or cleaning attachment as previously mentioned. For the extract mode as depicted in FIG. 7B, the two inlets 154, 156 are not aligned with any of the inlets 48, 50, 64 of the valve body and thus no clean water and/or detergent can travel to the pump 26. The diameters of the inlets in the valve body and valve stems can be altered for desired amount of liquid flows and flow rates.

Referring to FIGS. 5 and 6, a lockout pin 164 extends through a horizontally extending slot 166 (FIG. 1) passing through the front grip half 86. The inner end 174 of the lockout pin 164 is received in a "S-shaped" recess 168 (FIG. 2) in the front surface of the handle stem 70. The lockout pin 164 includes a head portion 170 and base portion 172 that sandwich portions of the front grip half 86 located on opposite sides of the slot 166 (FIG. 1) to allow the lockout pin 164 to slide longitudinally along the slot 166 (FIG. 1) while being secured to the front grip half 86.

Figure 2:
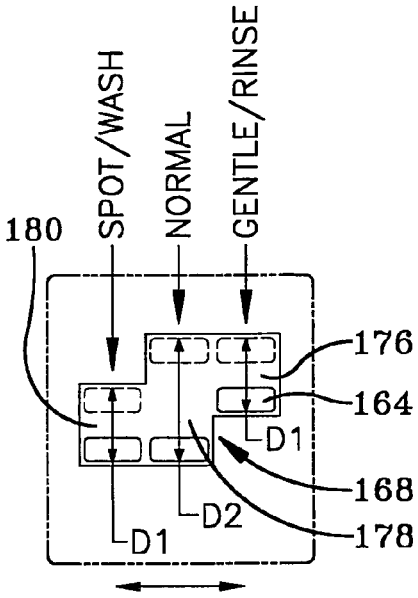
FIG. 2 is an enlarged view of the portion circled in FIG. 1 with the front handgrip removed.

As depicted in FIG. 2, the "S-shaped" recess 168 includes an upper portion 176, a middle portion 178, and a lower portion 180 for the lockout pin 164 to be selectively positioned therein, through horizontal movement of it as indicated by the horizontal arrows. The position of the lockout pin 164 in one of the upper portion 176, middle portion 178, and lower portion 180 correspond to respective gentle, normal, or spot wash cleaning cycles as indicated in FIG. 2. In particular, when the lockout pin 164 is positioned in the upper portion 176, the hand grip 74 can only move between the boundaries of the upper portion 176 of the recess 168 as indicated by the D1. Correspondingly, this limits the valve stems 134, 136 to be positioned in only the extract mode and rinse mode. When the lockout pin 164 is positioned in the lower portion 180, the hand grip 74 can only move between the boundaries of the lower portion 180 of the recess 168 as indicated by D3. Correspondingly, this limits the valve stems 134, 136 to be positioned in only the extract mode and wash mode. Finally, when the user positions the lockout pin 164 to be in the middle portion 178, the hand grip 74 can fully move up and down relative to the handle stem 70 and thus allow the valve stems 134, 136 to be positioned in the rinse, extract, or wash modes.

In operation, with the lockout pin 164 positioned in the normal cycle (D2 of FIG. 2), a user grasps the hand grip 74 of the carpet extractor 10 and squeezes the trigger portion 120 with the index finger to unlock the grip rod 76 from the handle stem 70 as shown in FIG. 5. The user then pushes downwardly and forwardly on the hand grip 74 which moves the extractor 10 with the floor engaging portion 14 in the forward direction and also moves the grip rod 76 down relative to the handle stem 70, thereby positioning the valve stems 134, 136 in the wash cleaning mode (FIG. 7C). Thus, cleaning solution is distributed to the carpet or bare floor as previously mentioned. After completing this forward stroke, the user then pulls on the hand grip 74 moving the extractor 10 in the rearward direction and also moving the grip rod 76 up relative to the handle stem 70 thereby positioning the valve stems 134, 136 in the rinse cleaning mode (FIG. 7A). Thus, clean water is distributed to the carpet or bare floor as previously mentioned.

After completing this reverse stroke, the user then releases the trigger portion 120 and moves the hand grip 74 so that the protrusion 126 engages the pilot hole 128 thereby locking the hand grip 74 and grip rod 76 to the handle stem 70 as shown in FIG. 6. This causes the valve stems 134, 136 to be positioned in the extract cleaning mode (FIG. 7B). The user then pushes the extractor 10 in the forward direction to only extract soiled solution from the carpet or bare floor. If desired after the forward extracting stroke, the user can pull on the extractor 10 to extract the soiled solution from the carpet again. Also, the sequence of the cleaning modes can be altered to come up with multiple cleaning cycles. For example, a user may want to extract first, then wash, rinse and extract, or wash first, then extract on both the reverse and forward strokes, then rinse and extract. It should be noted that the control lever 118 could be removed and the hand grip 74 could be secured on the handle stem 70 at a location that positions the valve stems 134, 136 in the extract mode by constructing and arranging the hand grip 74 and handle stem 70 so that the frictional forces between them overcome the weight of the hand grip 74, yet will allow the hand grip 74 to reciprocally move from the extra force applied by a user.

Figure 8:
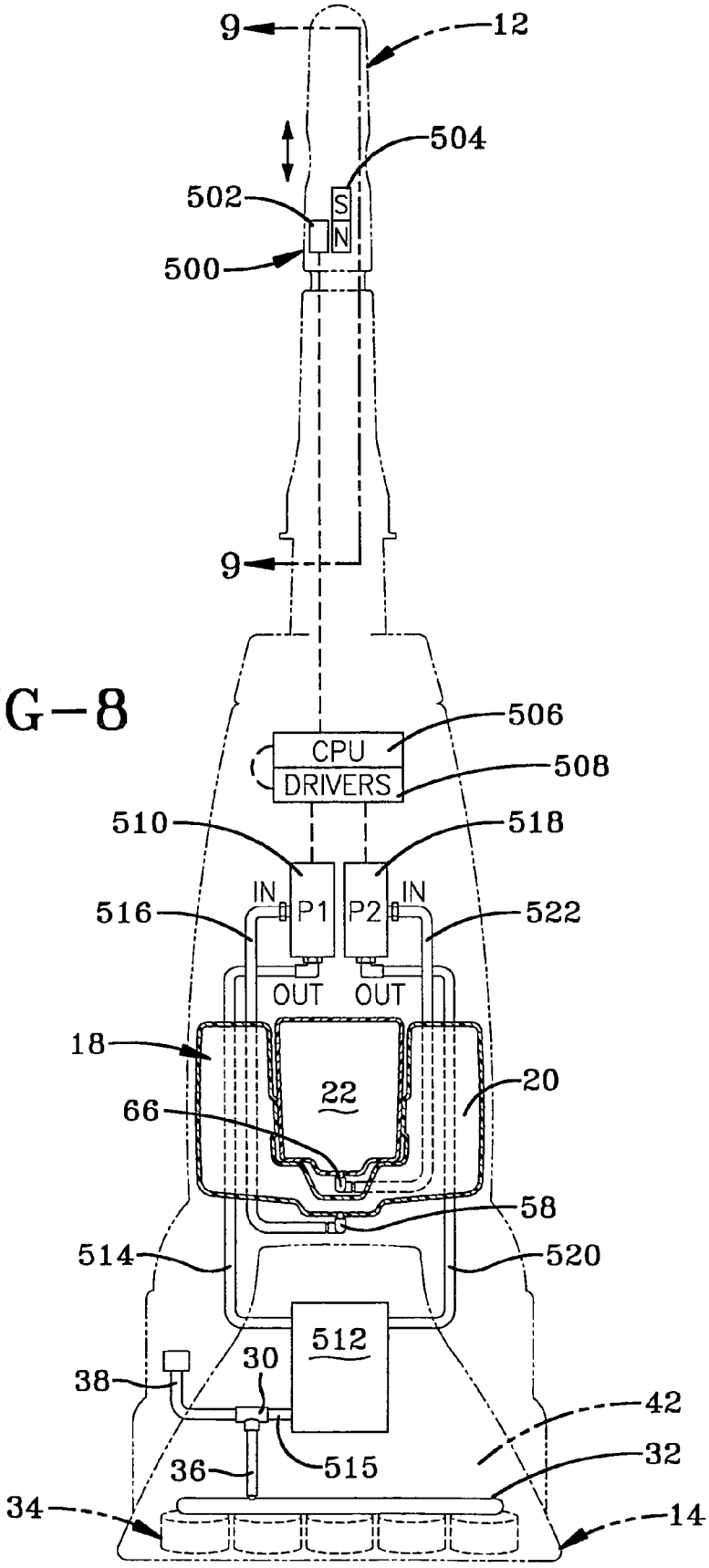
FIG. 8 is a diagrammatic partial, front sectional view of a carpet extractor incorporating a fluid distribution system of another embodiment according to the present invention.
Figure 9:
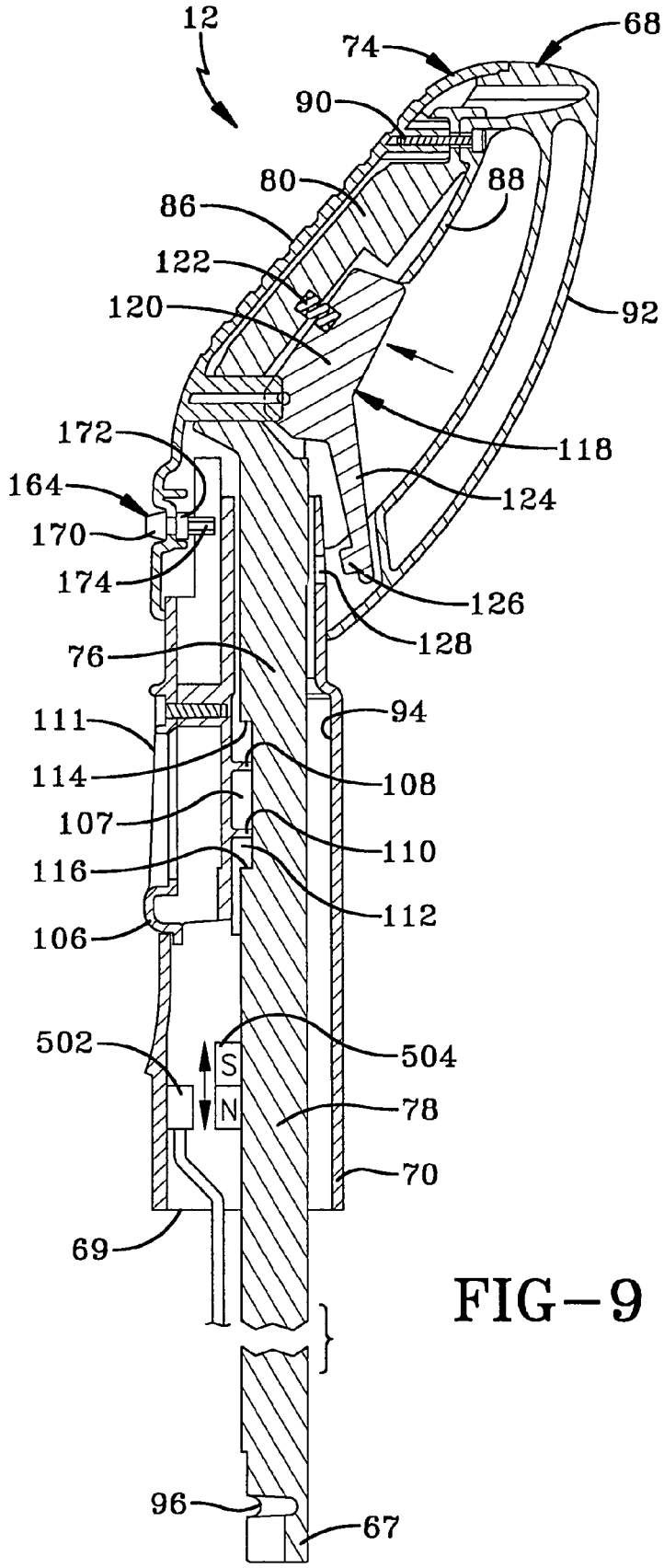
FIG. 9 is a sectional view as taken along line 9-9 in FIG. 8 showing the grip rod being unlock from the handle by the trigger control lever.

FIGS. 8 and 9 depict another embodiment of the present invention. In these figures, components from the embodiment shown in FIGS. 1 through 5 and 7A, 7B, and 7C, which are identical in structure and have identical functions will be identified by the same reference numbers. In this embodiment, a detecting unit 500 comprising a hall sensor 502 and magnet 504 is secured to the handle portion 12. As best seen in FIG. 9, the hall sensor 502 is secured to the inner surface 94 of the handle stem 70 across from the magnet 504, which is secured to the grip rod 76. The magnet 504 reciprocally moves up and down such that the hall sensor positions between the north (N) and south (S) poles of the magnet 504 during the movement as depicted by the arrows in response to similar reciprocal movement by the grip rod 76 and hand grip 74.

Referring to FIG. 8, the hall sensor 502 is electrically connected to a microprocessor (CPU) 506 and drive unit 508. A pump unit 510 for the clean water supply tank 20 is operatively connected to the drive unit 508, and fluidly connected to a mixing container 512 via a supply tube 514 and the clean water supply tank 20 via supply tube 516. A pump unit 518 for the detergent tank 22 is operatively connected to the drive unit 508, and fluidly connected to the mixing container 512 via a supply tube 520 and detergent tank 22 via supply tube 522. The mixing container 512 is fluidly connected to the valve 30 via the main supply tube 515. The microprocessor 506 is programmed to operate in the various cleaning modes depending on the entry and sequence (number of times) of entry into the proximity of the magnetic field of the north pole of the magnet 504 by the hall sensor 502 which will be explained in more detail.

In operation, with the lockout pin 164 positioned in the normal cycle (D2 of FIG. 2), a user grasps the hand grip 74 of the carpet extractor 10 and squeezes the trigger portion 120 with the index finger to unlock the grip rod 76 from the handle stem 70 as shown in FIG. 9. The user then pushes downwardly and forwardly on the hand grip 74 moving the magnet 504 to position the hail sensor 502 into the magnetic field of the north pole position of the magnet 504 and also moving the extractor 10 with the floor engaging portion 14 in the forward direction. At this position, the hail sensor 502 breaks into the positive gauss of the magnetic field of the north pole thereby causing the hall sensor 502 to output a high control signal to the microprocessor 506. Upon receipt of the signal, the microprocessor 506 activates the drive unit 508 to be in the wash mode which activates the pump 510 to draw water from the clean water supply tank 20 to the mixing container 512 and also activates the detergent pump 518 to draw detergent liquid from the detergent supply tank 22 to the mixing container 512. The combined solution then travels by gravity through the main supply tube 515 to the control valve 30, which selectively allows the liquid to flow to either the cleaning distributor 32 provided on a brush assembly 34 via a supply tube 36 or a hand-held cleaning attachment (not shown) via a supply tube 38.

After completing the forward stroke, the user then pulls upwardly and rearwardly on the hand grip 74 moving the magnet 504 to position the hall sensor 502 away from the proximity of the magnetic field of the north pole position of the magnet 504, and also moving the extractor 10 with the floor-engaging portion 14 in the rearward direction. When the hall sensor 502 is out of the proximity of the magnetic field of the north pole, the hall sensor 502 outputs a low control signal to the microprocessor 506. Upon receipt of the low control signal, the microprocessor 506 activates the drive unit 508 to be in the rinse mode which deactivates the pump 518 for the detergent supply tank 22 yet maintains activation of the pump 510 to draw clean water from the clean water supply tank 20 to the mixing container 512. The clean water then travels by gravity through the main supply tube 515 to the control valve 30, which selectively allows the clean water to flow to either the cleaning distributor 32 provided on a brush assembly 34 via a supply tube 36 or a hand-held cleaning attachment (not shown) via a supply tube 38.

After completing the reverse stroke, the user then pushes downwardly and forwardly on the hand grip 74 again moving the magnet 504 to position the hall sensor 502 in the magnetic field of the north pole of the magnet 504 and also moving the extractor 10 with the floor-engaging portion 14 in the forward direction. As previously mentioned, the hall sensor 502 outputs a high control signal to the microprocessor 506. However, with the hall sensor 502 being in the magnetic field for the second time, the microprocessor 506 is programmed to activate the drive unit 508 to be in the extract mode which deactivates both pumps 510, 518 thereby allowing no liquid to flow into the mixing container 512 and subsequently to the cleaning surface. For the subsequent forward stroke, the microprocessor 506 is programmed to activate the drive unit 508 to also be in the extract mode upon receipt of the low control signal from the hall sensor 502, when it no longer is in the proximity of the magnetic field of the north pole for the second time.

It should be noted that the microprocessor 506 can be programmed to change the sequence of cleaning modes as desired by the user. In this manner, a touch screen 111 is mounted across the outer recess of the stop pocket 106 and electrically communicates with the microprocessor by remote control. A user touches the touch screen 111 which sends or transmits a signal to the microprocessor 506 which is programmed to cause the extractor 10 to operate in the previously mentioned normal, gentle, or spot cleaning cycles in response to the number of times the user touched the screen 111, after the extractor is turned on. It should be noted that the cleaning cycle can be user defined as well. The touch screen 11 could have various operating mode and user information displayed in the form of alphanumeric and graphic light crystal displays (LCD's). Alternatively, other indicating devices such as light emitting diodes (LED) could be use to indicate such user feedback information.

Also, other detecting units can be substituted for the hall sensor 502 and magnet 504. For example, a sequencer, a mechanical switch or an optical switch could be used as the detecting unit. Further, other user input devices could be substituted or used in conjunction with the touch screen 111 to select the cleaning mode. For example, such devices could be a tactile membrane switch or a push button.

Figure 10:
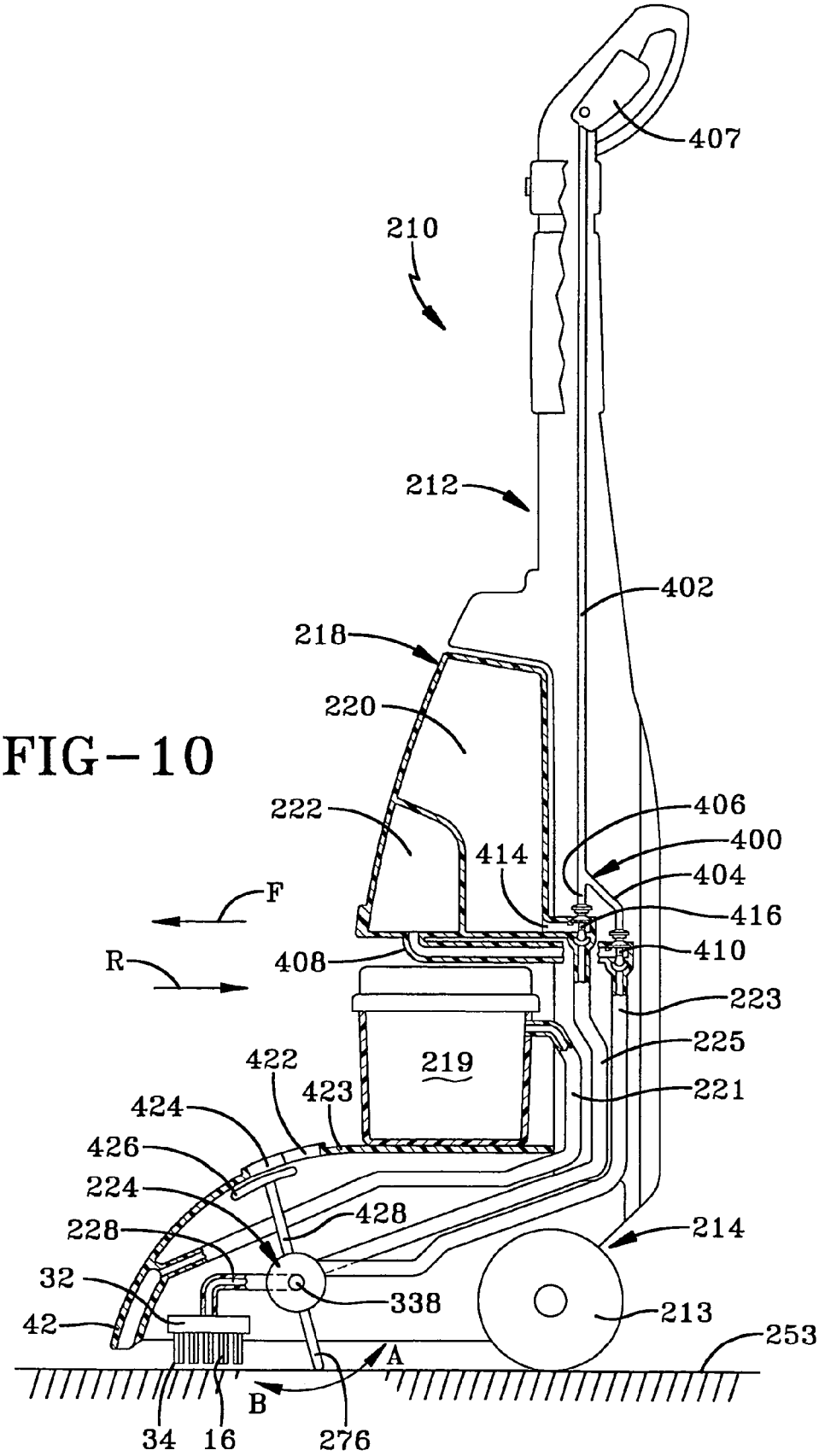
FIG. 10 is a diagrammatic partial, side sectional view of a carpet extractor incorporating a fluid distribution system according to still another embodiment of the present invention.

FIG. 10 through 15 show still another embodiment of the invention. In these figures, components from the embodiment shown in FIGS. 1 through 5 and 7A, 7B, and 7C, which are identical in structure and have identical functions will be identified by the same reference numbers. Referring to FIG. 10, the upright carpet extractor 210 includes a pivotal handle portion 212 for propelling a floor-engaging portion or foot 214 with wheels 213 over a cleaning surface 253. The floor-engaging portion 214 preferably includes a plurality of rotating scrub brushes 16 for scrubbing the cleaning surface or carpet 253 (or bare floor). A supply tank assembly 218 is removably mounted to the handle portion 212 of the extractor. The supply tank assembly 218 comprises a clean water supply tank 220 and a detergent supply tank 222 adjacent to the clean water supply tank 220.

A push rod assembly 400 comprising an upper portion 402 and a pair of lower legs 404, 406 integrally formed with the upper portion 402. The upper portion 402 extends upwardly through the handle portion and is pivotally connected at its upper end to a trigger switch 407, which is pivotally connected to the handle portion 212 and urged upwardly by a pair of cantilever springs (not shown). One leg 404 extends downwardly to a reservoir 408, which is fluidly connected to the detergent tank 222, and bears against a release valve 410 positioned over an opening in the reservoir 408. The other leg 406 of the push rod assembly 400 extends downwardly to a reservoir 414, which is fluidly connected to the clean water supply tank 220, and bears against a release valve 416 positioned over an opening in the reservoir 414. This release valve 416 is similar to that of the detergent tank 222. The release valves 410, 416 are opened through downward movement of the legs 404, 406 pressing against them. Further details of such a water release valve, reservoir, and trigger are disclosed in co-owned U.S. Pat. No. 5,500,977 and commonly owned pending U.S patent application Ser. No. 09/327,091 the disclosures of which are hereby incorporated herein as of reference. Upon an operator squeezing the trigger 407 upwardly, this causes the trigger 407 to rotate counter clockwise resulting in downward movement of the push rod assembly 400, thereby opening the release valves 410, 416 causing gravitational flow of clean water and detergent from their respective reservoirs 414, 408.

The clean water and detergent flow by gravity from their respective tanks 220, 222 to respective inlets (FIG. 11) of a valve assembly 224 via respective supply tubes 225, 223. The valve assembly 224 is mounted to the floor-engaging portion 214. The cleaning liquid comprising the detergent and/or clean water from the valve assembly 224 travels through a main supply tube 228 to a cleaning distributor 32 provided on a brush assembly 34. The cleaning liquid distributor 32 evenly distributes the cleaning liquid to each of the rotary scrub brushes 16. The scrub brushes 16 then spread the cleaning liquid onto the carpet 253 (or bare floor), scrub the cleaning liquid into the carpet, and dislodge embedded soil. Such a distributor 32 and scrub brushes 16 are substantially disclosed in commonly owned U.S. Pat. No. 5,867,857, the disclosure of which is hereby incorporated herein as of reference.

As is commonly known, the carpet extractor 210 distributes cleaning solution to the carpeted cleaning surface 253 and substantially simultaneously extracts it along with the dirt on the carpet 253 in a continuous operation. In particular, soiled cleaning liquid is extracted from the carpet 253 by a suction nozzle 42, which communicates with a recovery tank 219 via an air duct 221. A vacuum is created in the recovery tank 219 by a motor fan assembly (not shown) that draws air from the recovery tank 219 and exhausts the air to the external atmosphere in a well-known, conventional manner. The recovery tank 219 includes an air and liquid separator (not shown), as is understood by one of skill in the art, for separating liquid from the air entering the recovery tank 219 and recovering the separated liquid in the tank 219. A suitable upright carpet extractor is disclosed in co-owned U.S. Pat. No. 5,500,977, the disclosure of which is hereby incorporated herein as of reference.

Figures 11, 12, 13:
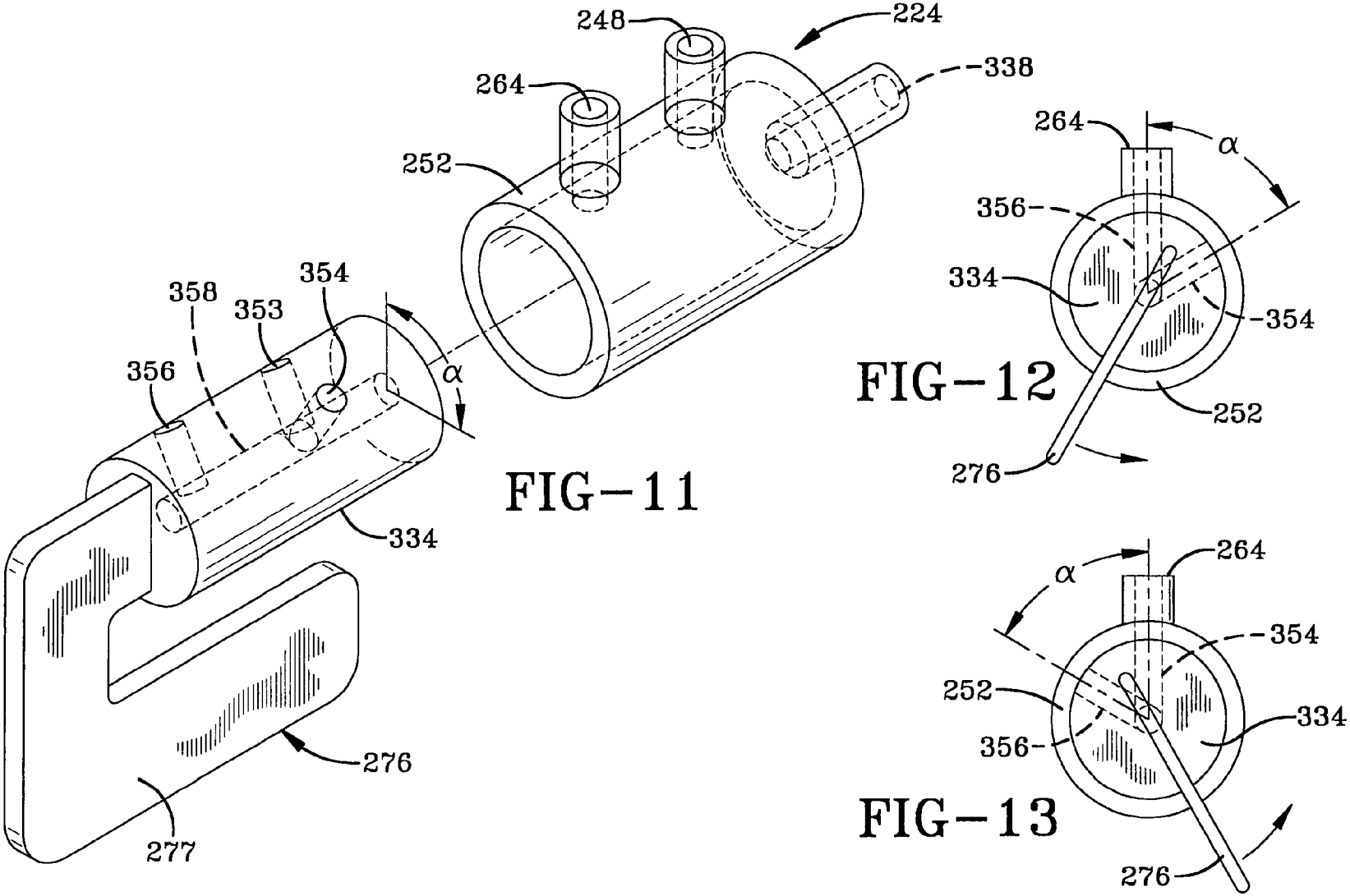
FIG. 11 is an exploded view of the valve assembly with the tongue of the embodiment of FIG. 10.
FIG. 12 is a left side view of FIG. 11 with the valve assembly assembled and positioned in the wash cleaning mode.
FIG. 13 is a left side view of FIG. 11 with the valve assembly assembled and positioned in the rinse-cleaning mode.
Figure 14:
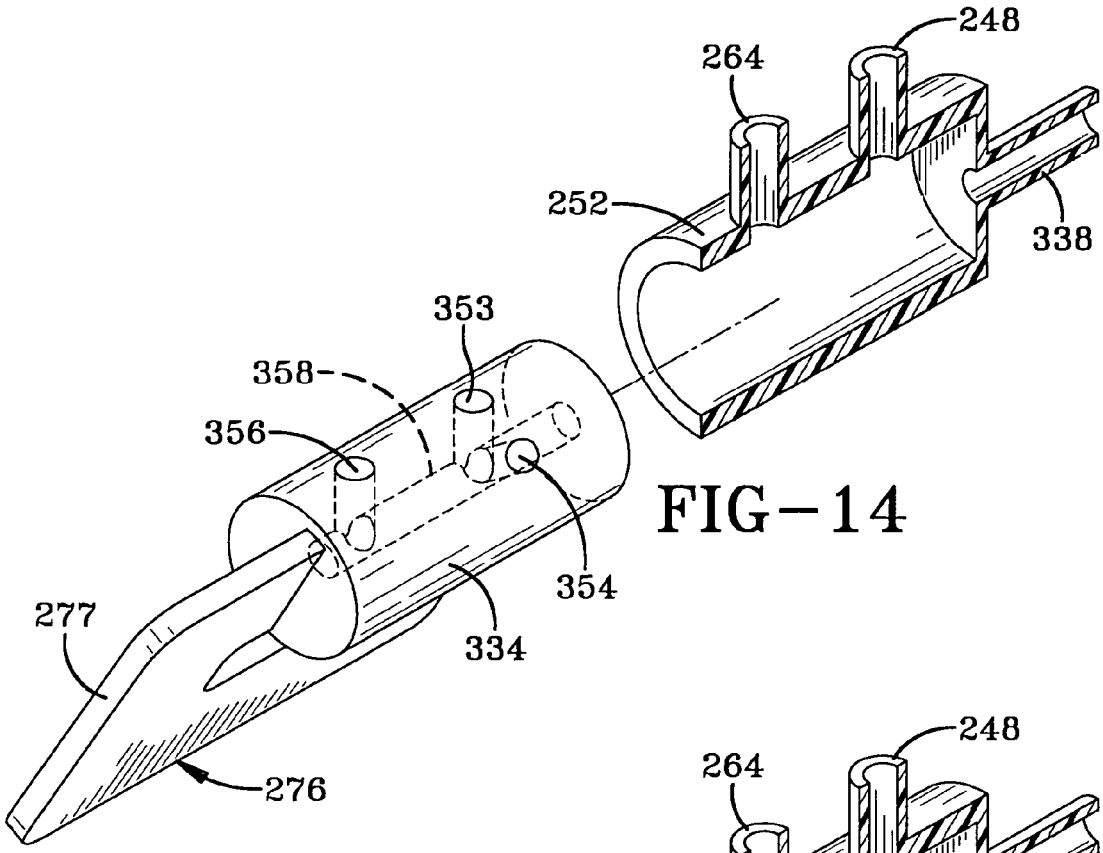
FIG. 14 is an exploded view of the valve assembly with the tongue of the embodiment of FIG. 10 in the wash cleaning mode.
Figure 15:
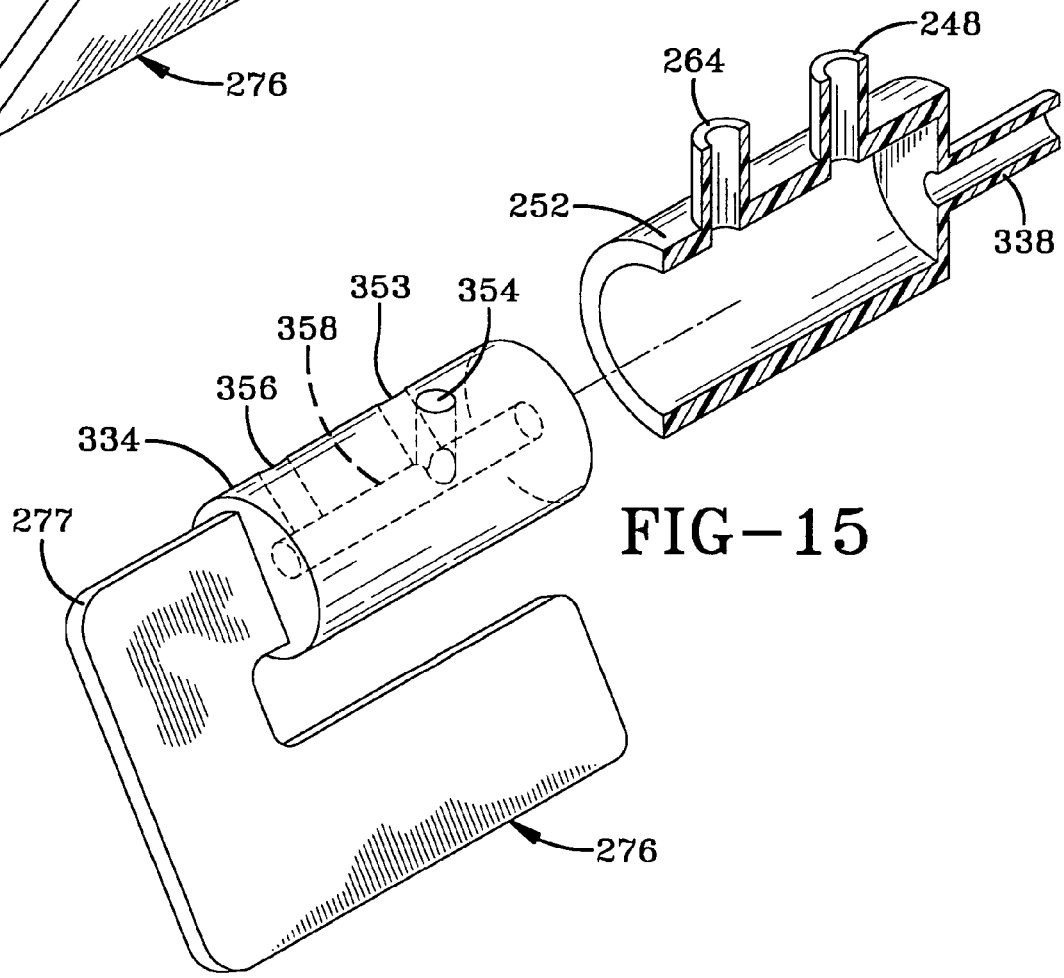
FIG. 15 is an exploded view of the valve assembly with the tongue of the embodiment of FIG. 10 in the rinse-cleaning mode.

As seen in FIGS. 11, 14, and 15, the valve assembly 224 includes a hollow cylindrical shell or body 252 for receiving a hollow cylindrical valve stem 334. The stem 334 extends laterally and has a cylindrical internal passage 358 fluidly communicating with an outlet 338 in the valve shell 252, which fluidly connects with the main supply tube 228. The valve shell 252 has an inlet 264 for the detergent supply tube 223 and an inlet 248 for the clean water supply tube 225. The stem 334 has a pair of inlets 353, 354 which selectively align with the inlet 248 of the valve shell 252 for the clean water and an inlet 356, which selectively aligns with the inlet 264 of the valve shell 252 for the detergent solution, which will be explained in more detail. The inlets 248, 264 of the valve shell have similar diameters as the inlets 353, 354, and 356 of the valve stem 334. A flexible J-shaped tongue 276 is connected at the end of the valve stem 334 opposite the outlet 338 of the shell 252. The tongue 276 includes a leg portion 277 that is parallel with the longitudinal axis of the valve stem 334 and extends along the length of the valve stem 334.

Referring to FIG. 10, the tongue 276 contacts the cleaning surface 253 at the leg portion 277. The tongue 276 moves to position A when the floor engaging portion 214 of the extractor 210 moves in the forward (F) direction, and moves to position B when the floor engaging portion 214 of the extractor 210 moves in the rearward direction (R). The rotating movement of the tongue 276 between positions A and B will in turn cause rotating movement of the valve stem 334 within the valve shell 252 to respective wash and rinse cleaning modes, which will be explained further in more detail. The tongue 276 is composed of a flexible material such that it will bend or deform slightly as it rotates and contacts the cleaning surface 253 so that it will not cause the floor-engaging portion 214 to rise. Alternatively, the tongue 276 may just have a flexible end at the leg portion 277 to perform this function.

The inlets 248, 264 of the valve shell 252 align with inlets 353, 354, and 356 of the valve stem 334 through selective rotating positioning of the valve stem 334 with respect to the valve shell 252 for desired cleaning modes. In particular, for the rinse-cleaning mode as depicted in FIG. 15, the inlet 354 in the stem 334 aligns with the inlet 248 in the valve shell 252 for the clean water. However, as also shown in FIG. 13, the inlet 356 in the stem 334 is not aligned with the inlet 264 of the valve shell 252 for the detergent. Thus, clean water can travel through the chamber or passageway 358 in the valve stem 334 to the outlet 338 of the valve shell 252. As shown in FIG. 10, the water would then travel to the cleaning distributor 32 via the main supply tube 228 as previously mentioned.

For the wash cleaning mode as depicted in FIG. 14, the inlet 356 in the stem 334 aligns with the inlet 264 of the valve shell 252 (also seen in FIG. 12) for the detergent and the inlet 353 in the stem 334 aligns with the inlet 248 of the valve shell 252 for the clean water. Thus, the liquid detergent and clean water can flow to the passageway 358 of the valve stem 334 where they are mixed and the combined cleaning solution travels to the outlet 338 of the valve shell 252. As depicted in FIG. 10, the combined cleaning solution would then travel through the main supply tube 228 to the cleaning distributor 32 as previously mentioned. A locking assembly could also be employed to allow the valve stem 334 to be selectively position in only the rinse mode or wash mode. Alternatively, a coupling member (not shown) could be pivotally connected between the tongue 276 and one of the wheels 430 so that the tongue 276 could rotate in response to movement of the wheels 213 upon the floor engaging portion 214 being moved between the forward and rearward direction.

With reference to FIG. 10, a rinse mode window 422 and a wash mode window 424 is preferably located on the hood portion 423 of the floor-engaging portion 214 above the valve assembly 224. Visible through the windows is a brightly colored plate 426 attached to an arm 428 which is attached to the tongue 276 to indicate the cleaning mode of the extractor 210 with respect to the rotational position of the valve stem 334 in each mode. In particular, when the valve stem 334 is rotated to the rinse mode, this movement causes the plate 426 to be positioned to be visible in the rinse mode window 422. When the valve stem 334 is rotated to the wash mode, this movement causes the plate 426 to be positioned to be visible in the wash mode window 424.

In operation, the operator grasps the handle portion 212 and squeezes the trigger 407 to open the release valves 410, 416. The operator pushes the extractor 210 in the forward direction (F) thereby rotating the tongue 276 to position A and positioning the valve stem 334 in the wash cleaning mode (FIGS. 12 and 14). Thus, cleaning solution is distributed to the carpet or bare floor as previously mentioned. After completing this forward stroke, the operator then pulls the extractor 210 in the rearward direction (R) thereby rotating the tongue 276 to position B and positioning the valve stem 334 in the rinse-cleaning mode (FIGS. 13 and 15). Thus, clean water is distributed to the cleaning surface 253 as previously mentioned. It should be noted that the invention could alternatively operate without a trigger, a push rod assembly, and release valves. In this respect, the clean water and detergent would flow through their respective supply tubes 225, 223 down to the valve assembly 224 where they would be selectively allowed to flow as previously mentioned. The operator could position the floor-engaging portion 214 so that the tongue 276 is centrally located between A and B, thereby positioning the valve stem 334 with respect to the valve shell 252 so that none of the inlets 353, 354, and 356 in the valve stem 334 are aligned with the inlets 248, 264 in the valve shell 252 to allow any fluid communication between them.

Figure 16:
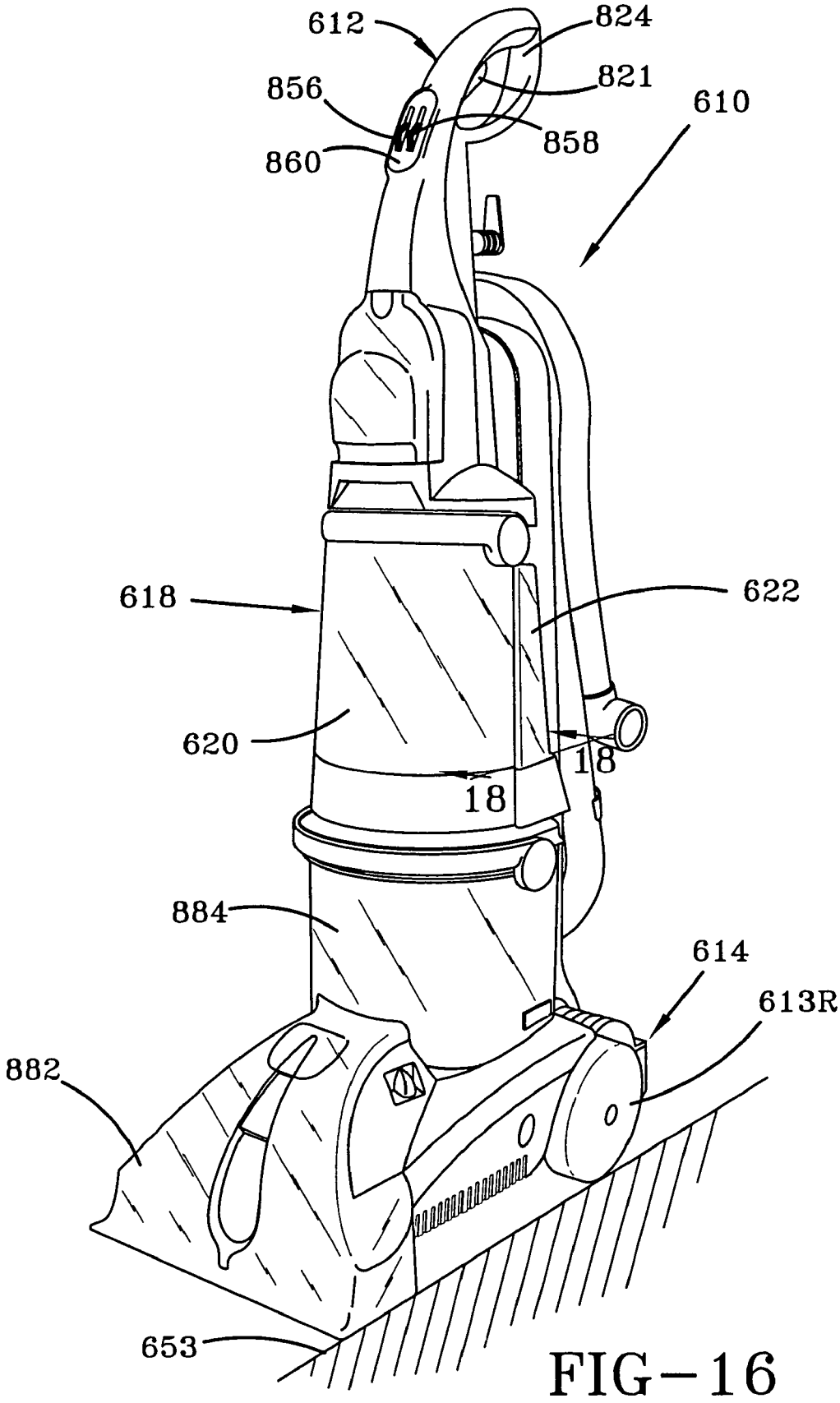
FIG. 16 is a perspective view of a carpet extractor incorporating a fluid distribution system according to another embodiment of the present invention.

FIGS. 16 through 31 illustrate still another embodiment of the invention. Referring to FIG. 16, the upright carpet extractor 610 includes a pivotal handle portion 612 for propelling a floor-engaging portion or foot 614 with a pair of wheels 613R and 613L (FIG. 25) over a cleaning surface 653 such as a carpet. The floor-engaging portion 614 preferably includes a plurality of rotating scrub brushes 616 (FIG. 20) for scrubbing the cleaning surface or carpet 653. A supply tank assembly 618 is removably mounted to the handle portion 612 of the extractor 610 and includes a combination carrying handle and securement latch 619 pivotally connected thereto. The supply tank assembly 618 comprises a clean water supply tank 620 and a detergent supply tank 622 adhesively mounted to the clean water supply tank 620.

Figure 17:
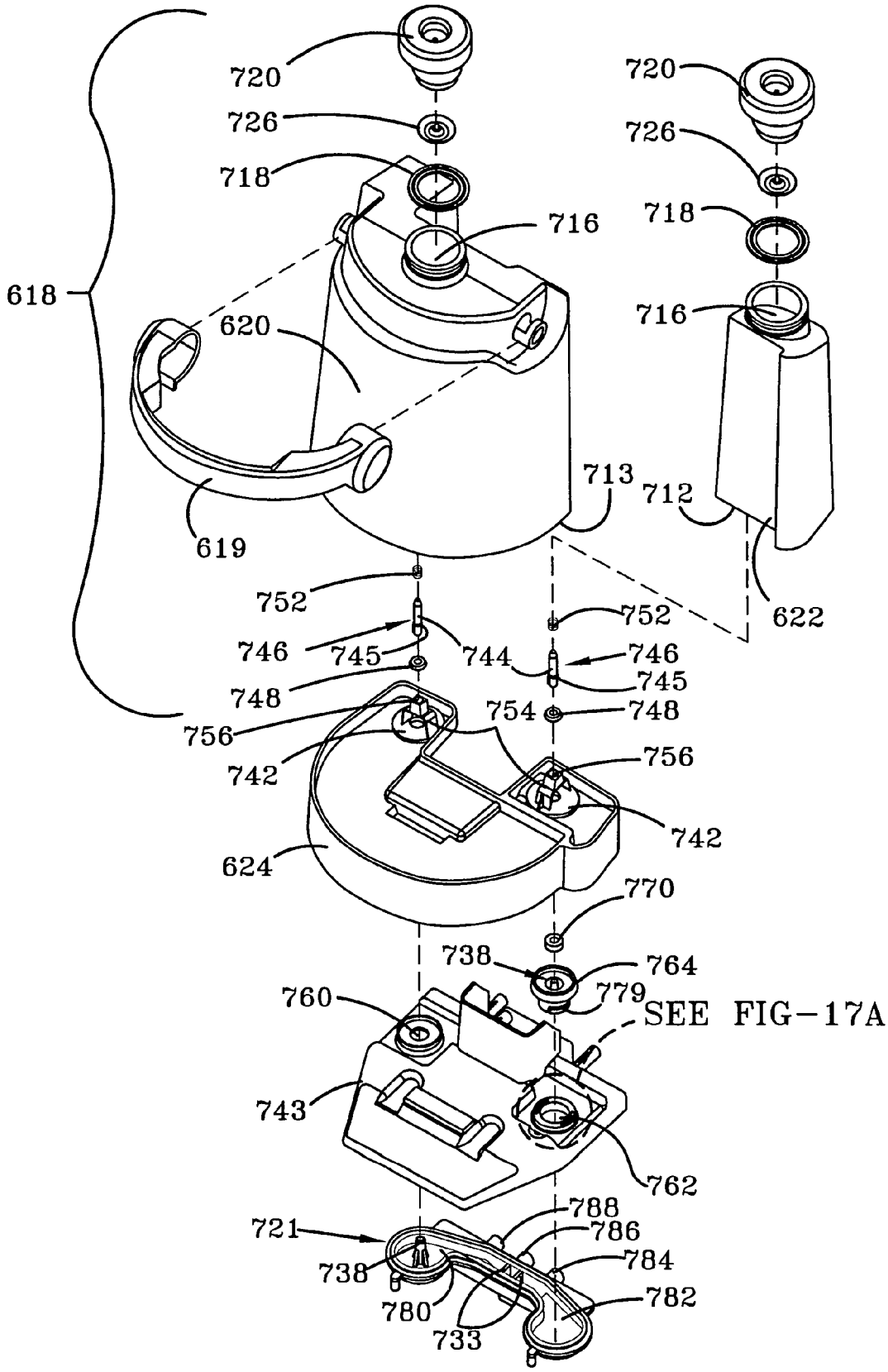
FIG. 17 is an exploded view of the upper portion of the fluid distribution system of the FIG. 16.

As depicted in FIG. 17, the supply tank assembly 618 is positioned upon a bottom base 624, which with the tank assembly 618 is removably mounted to a support shelf 743, which is secured to the handle portion 612 (FIG. 16), and fluidly connected to a u-shaped reservoir 721 underneath the support shelf 743 via respective solution release valves 746. The reservoir 721 is vibrationally welded to the underside of the support shelf 743. Each of the supply tanks 620, 622 includes a solution release valve 746. The solution release valve 746 is normally in the closed position. However, as the tank assembly 618 is placed upon the reservoir 721, the solution release valve 746 in each of the supply tanks 620, 622 opens permitting clean water from the clean water supply tank 620 and detergent from the detergent supply tank 622 to flow into the reservoir 721. Upon removal of the tank assembly 618 from the reservoir 721, the solution release valve 746 closes prohibiting liquid from flowing out of the supply tanks 620, 622.

Figure 18:
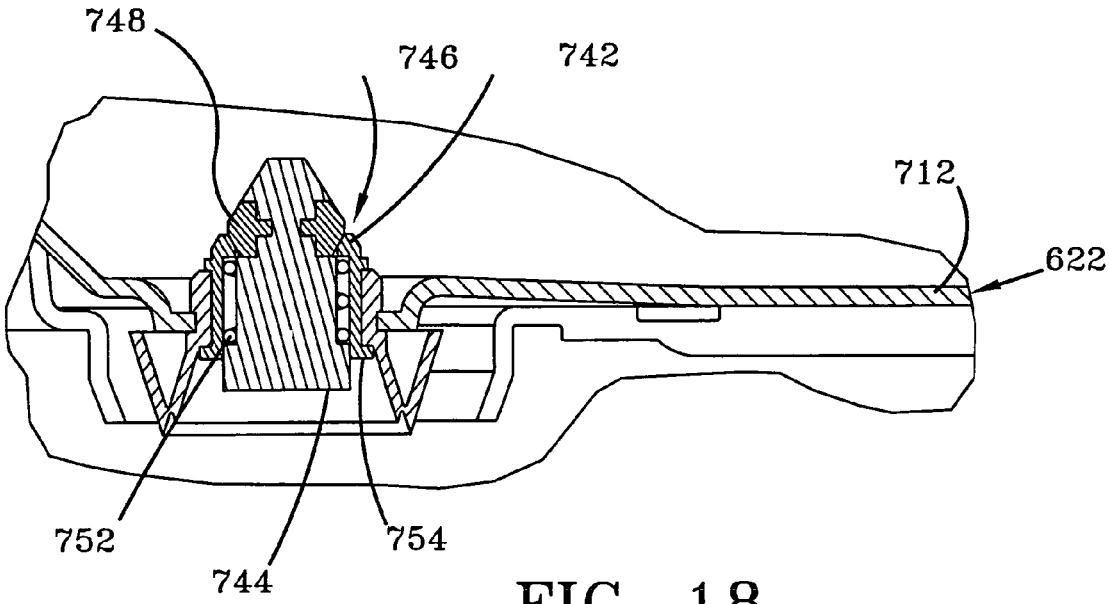
FIG. 18 is a partial sectional view taken along line 18-18 of FIG. 16.

As seen in FIG. 18, the solution release valve 740 is incorporated into bottom plate 712 of the detergent tank 622. The other solution release valve 746 is incorporated into the bottom plate 713 of the clean water tank 620 which is of similar construction. Thus, only the one for the detergent tank 620 will be described in more detail. The solution release valve 746 comprises a valve body 742 having an elongate plunger 744 extending coaxially upward therethrough. The plunger 744 having an outside diameter less than the inside diameter of the valve body 742 is provided with at least three flutes 745 (FIG. 17) to maintain alignment of the plunger 744 within the valve body 742 as the plunger 744 axially translates therein and permits the passage of fluid therethrough when the plunger 744 is in the open position.

As seen in FIG. 17, an open frame housing 754 is located atop the valve body 742 having a vertically extending bore 756 slidingly receiving therein the upper shank portion of the plunger 744. An elastomeric circumferential seal 748 circumscribes plunger 744 for sealingly engaging valve body 742. As depicted in FIG. 18, seal 748 is urged against the valve body 742 by action of the compression spring 752, circumscribing plunger 744. The spring 752 is positioned between the frame 754 and the seal 748. The solution release valve 746 is normally in the closed position. However, with reference to FIG. 17, as the supply tank assembly 618 is placed upon the support shelf 743 of the handle 612, the pin 738 of the reservoir 721 aligns with plunger 744 and is received within flutes 745, thereby forcing plunger 744 upward, compressing spring 752, and opening valve seat 742 permitting detergent from the detergent supply tank 622 to flow into the reservoir 721. Upon removal of supply tank assembly 618 from the support shelf 743, the energy stored within compression spring 752 closes the valve seat 742. Such a solution release valve is also disclosed in co-owned U.S. Pat. No. 5,500,977, the disclosure of which is hereby incorporated by reference.

The support shelf 743 includes two circular openings 760, 762 align with their respective solution release valves 746 associated with the corresponding clean water and detergent tanks 620, 622. The pin 738 associated with the solution release valve 746 of the clean water tank 620 is integrally formed on the reservoir 721 and extends through the opening 760. The pin 738 associated with the solution release valve 746 of the detergent tank 622 is integrally form on a metering plate 764, which covers the opening 762.

Figure 17A:
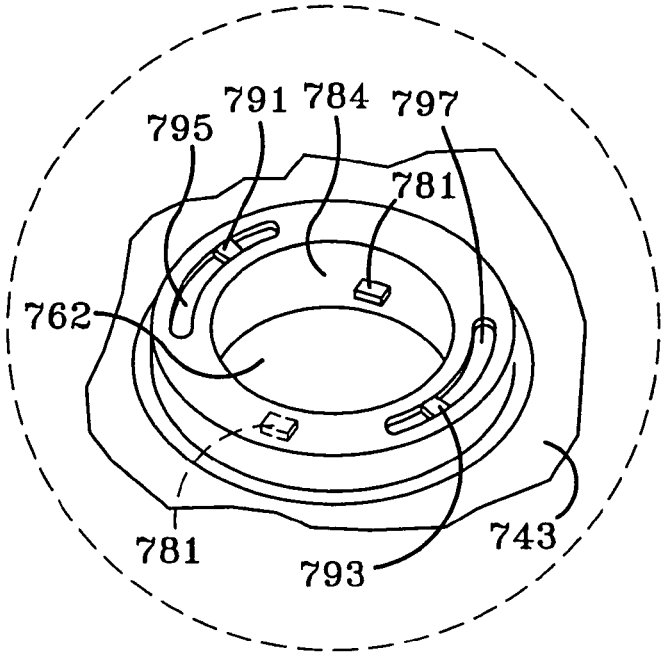
FIG. 17A is an enlarge view of the section of the support shelf of circled in FIG. 17.
Figure 31:
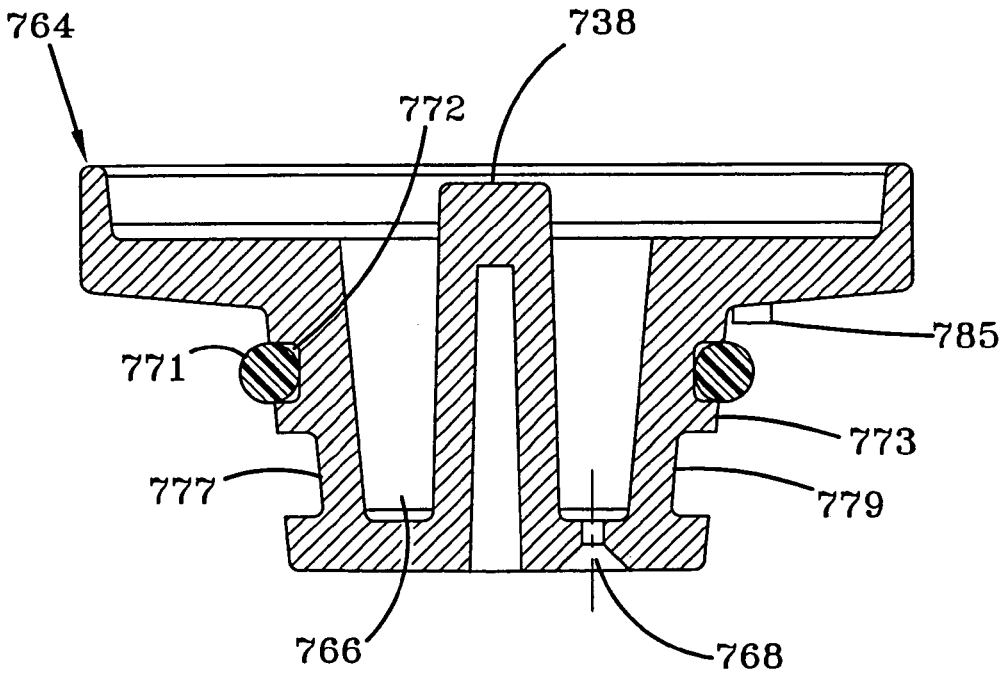
FIG. 31 is a vertical side sectional view through the center of the metering plate shown in FIG. 18.

As seen in FIG. 31, the metering plate 764 is generally circular in shape and includes a channel 766 circumferentially extending around the pin 738. The bottom of the channel 766 has an orifice 768 which meters the detergent solution at a value for the desired mix with the clean water. A toroid or donut shaped filter 770 (FIG. 17) is inserted into the channel for filtering out particles of the detergent. The metering plate 764 has an outer groove 772 extending around the wall 773 surrounding the channel 766 that receives a seal 771. A pair of L-shaped grooves 777, 779 are also formed on opposite sides of the wall 773. Referring to FIG. 17A, a pair of lateral projections 781 extending from the inner wall 789 (FIG. 17A) of the opening 762 (FIG. 17A) in the support shelf 743 each slidably engage a respective groove 777 or 779 (FIG. 31) to secure the metering plate 764 (FIG. 31) to the support shelf 743 within the opening 762, as the metering plate 764 is inserted into the opening 762 and turned. Also, as the metering plate 764 is turned, a pair of protrusions 785 (FIG. 31) extending down from the upper portion of the metering plate 764 ride up respective ramps 791, 793 formed in respective recesses 795, 797 and seat down behind the ramps to additionally secure the metering plate 764 to the support shelf 743 within the opening 762.

Figure 19:
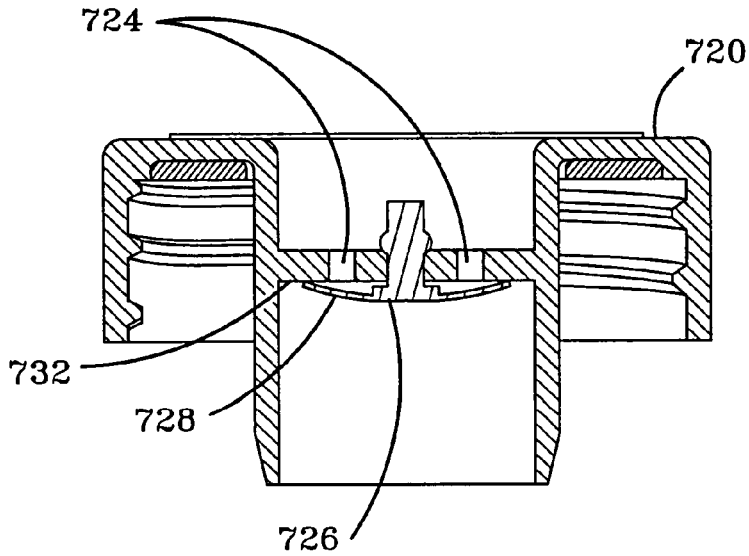
FIG. 19 is a vertical sectional view of the cap and valve provided therein for either the clean water supply tank or detergent tank shown in FIG. 17.

As also depicted in FIG. 17, each of the tanks 620, 622 has a cap 720 covering a top opening for filling the corresponding clean water tank 620 or detergent tank 622 with liquid. As best seen in FIG. 19, the top of cap 720 comprises a multiplicity of air breathing orifices 724. An elastomeric umbrella valve 726 is mounted to the underside of the top of the cap 720 under the orifices 724. As the ambient pressure within the associated tank 620 or 622 drops, by discharge of cleaning solution from therein, atmospheric pressure acting upon the top side of umbrella valve 726 causes the peripheral edge 728 to unseat from the surface 732 of cap 720 thereby permitting the flow of atmospheric air into the associated tank 620 or 622 until the ambient pressure therein equals atmospheric.

Once the pressure on both sides of the umbrella valve 726 equalize due to one of the shut off valves 800, 820 (FIG. 20) closing and the pump 808 (FIG. 20) being turned off, the energy stored by deflection of the umbrella valve causes the peripheral edge 728 to reseat itself against surface 732 thereby preventing leakage of cleaning solution through the outlet of the associated tank 620 or 622. In effect, this prevents cross flow between the two tanks 620, 622, when the extractor unit is turned off, thereby prohibiting mixing of the solutions in the tanks 620, 622. Referring to back to FIG. 17, cap 720 and flat circular seal 718 sealingly close fill-opening 716. Liquid pressure against umbrella valve 726 further urges peripheral edge 728 against surface 732 thereby providing a leak free container. Such a valve is disclosed in co-owned U.S. Pat. No. 5,500,977, the disclosure of which is hereby incorporated by reference.

The reservoir 721 has a pair of dividing plates 733 which separates into a first compartment 780 fluidly connected to the clean water tank 620 and a second compartment 782 fluidly connected to the detergent tank 622. The first compartment 780 includes inner and outer outlet ports 786, 788. The second compartment 782 includes an outlet port 784.

Figure 20:
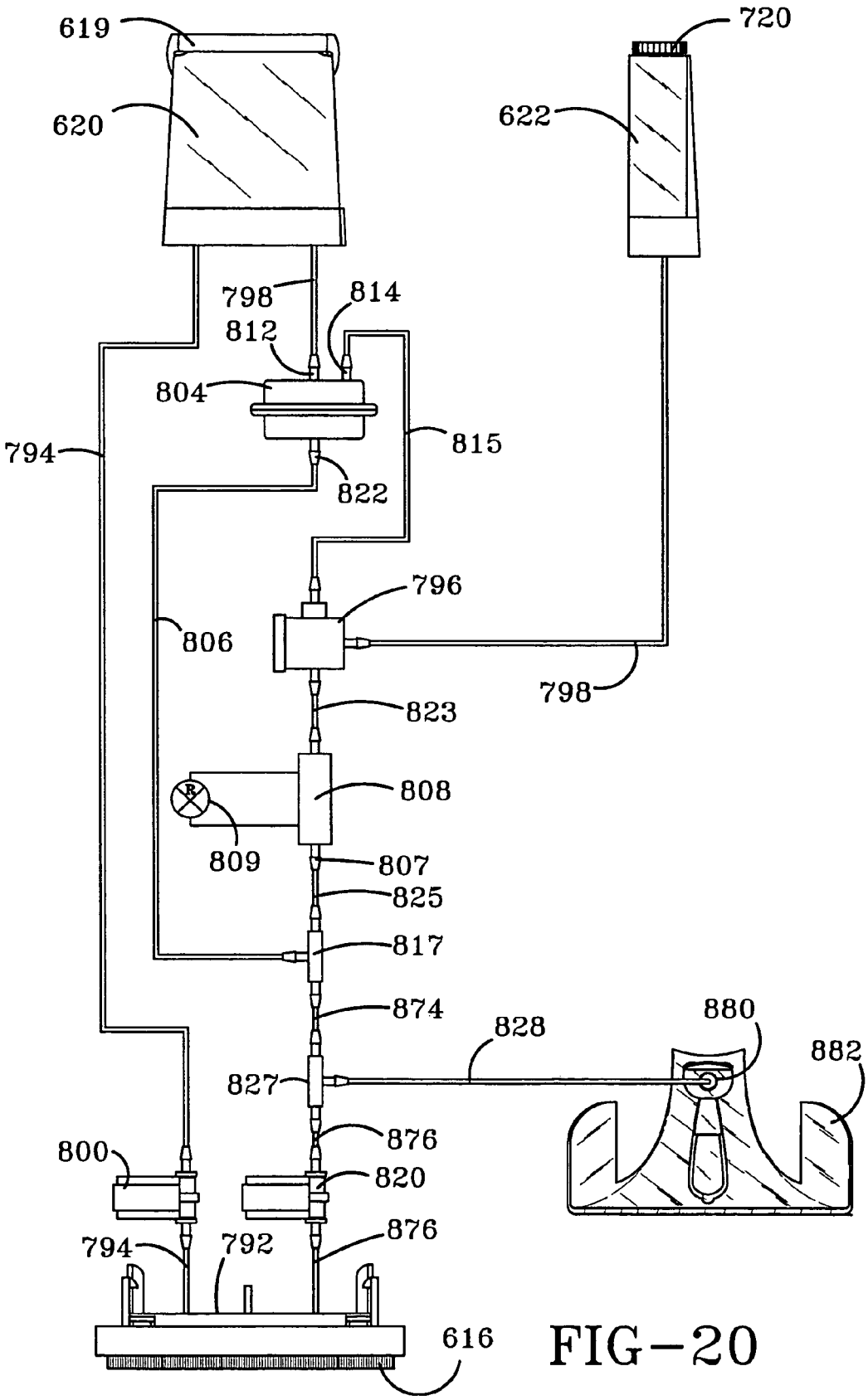
FIG. 20 is a schematic view of the fluid distribution system of the embodiment shown in FIG. 16.

FIG. 20 illustrates the overall solution distribution system which will be described below. The inner outlet port 786 (FIG. 17) of the first compartment 780 (FIG. 17) is fluidly connected to a mixing Tee 796 via a flexible hose 790 and the outer outlet port 788 (FIG. 17) is fluidly connected to a distributor 792 via a flexible hose 794. The outlet port 784 (FIG. 17) of the second compartment 782 (FIG. 17) is fluidly connected to the mixing Tee 796 via a suitable flexible hose 798. A shut off valve 800 is connected between the outer outlet port 784 of the second compartment 782 and distributor 792 for tuning on and off the flow of clean water used for rinsing. This shut off valve 800 is in the form of a solenoid valve, however, other types of valves also could be used.

Figure 21:
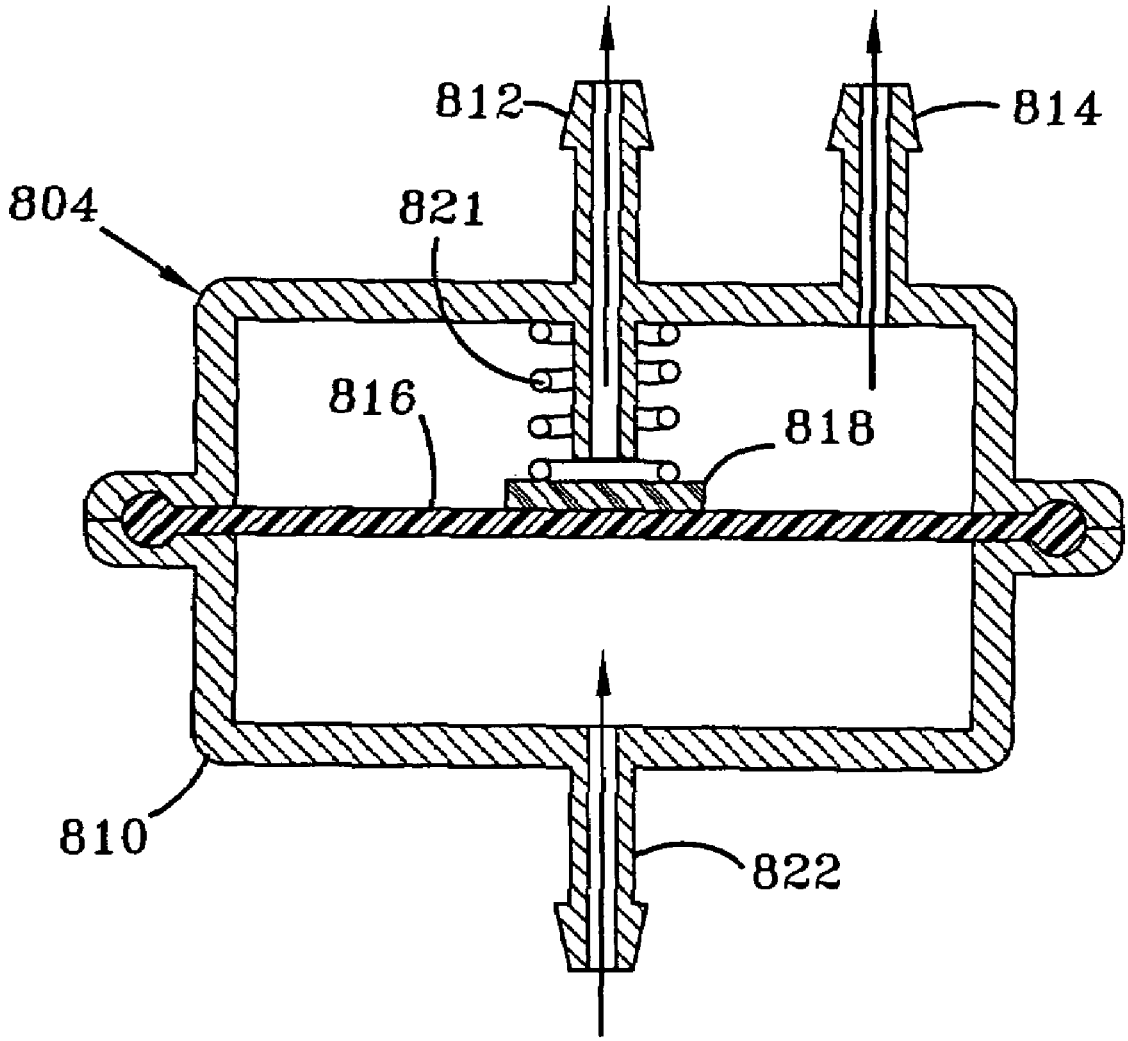
FIG. 21 is a vertical front section of the pressure-actuated shut off valve shown in FIG. 20.

A pressure actuated shut off valve 804 is connected between the inner outlet port 786 of the second compartment 782 and the mixing Tee 796 for turning off and on the flow of water. This shut off valve 804 is opened and closed by outside pressure via a conduit 806 connected between it and the outlet 807 of a pump 808 through a Tee 817. In particular, as shown in FIG. 21, the pressure actuated shut off valve 804 comprises a valve body 810 having a first port 812 fluidly connected to the clean water tank 620 and a second port 814 fluidly connected to the mixing Tee 796 via a flexible hose 815. A flexible rubber diaphragm 816 extends generally horizontally across the center of the valve body 810. The diaphragm 816 includes a valve seal 818 integrally formed on the diaphragm 816 at its center. The valve 804 includes a pressure port 822 fluidly connected to the outlet 807 (FIG. 20) of the pump 808.

In operation, when the pressure at the pressure port 822 is below a predetermined value such as 20 to 30 psi, the valve seal 818 is spaced from the pressure port 822 to allow water to flow in both directions. Such a pressure value at the pressure port 822 occurs when the main shut off valve 820 is opened. The pump 808 also pressurizes the water mixed with detergent to draw it to the distributor 792. In this example, water flows to the distributor 792 due to gravity and the pressure produced by the pump 808. However, in this open position, the pressure actuated shut off valve 804 could allow detergent to flow in the opposite direction, if for example, the pump 808 were placed between the valve 804 and the clean water tank 620 to draw the detergent to the clean water tank 620 by pressure.

When the pressure exerted on the diaphragm 816 exceeds the predetermined value, it flexes the diaphragm 816 towards the first port 812, urging the valve seal 818 against the first port 812, thereby sealing the first port 812 to close the valve 804. Thus, with the valve 804 closed, clean water or detergent is prevented from flowing through it. When the pressure lowers below the predetermined value, the diaphragm 816 flexes back to unseal the valve seal 818 from the first port 812 thereby opening the valve 804. Optionally, a spring 821, inserted around the portion of the first port 812 extending into the valve body 810, can be positioned between the inner upper wall 811 of the valve body 810 and diaphragm 816 to urge the valve seal 818 to unseal quicker.

Referring back to FIG. 20, the outlet of the mixing Tee 796 is fluidly connected via flexible hose 823 to the inlet of the pump 808 which provides pressure to draw the cleaning solution to the distributor 792. A relief valve 809 is fluidly connected across the pump 808 to limit the pressure at the outlet 807 of the pump 808 to a predetermine value. The outlet 807 of the pump 808 is fluidly connected to the main shut off valve 820 via flexible hoses 825, 874 and 876. This shut off valve 820 is in the form of a solenoid valve, however, other electrical actuated valves could be also used.

Figure 22:
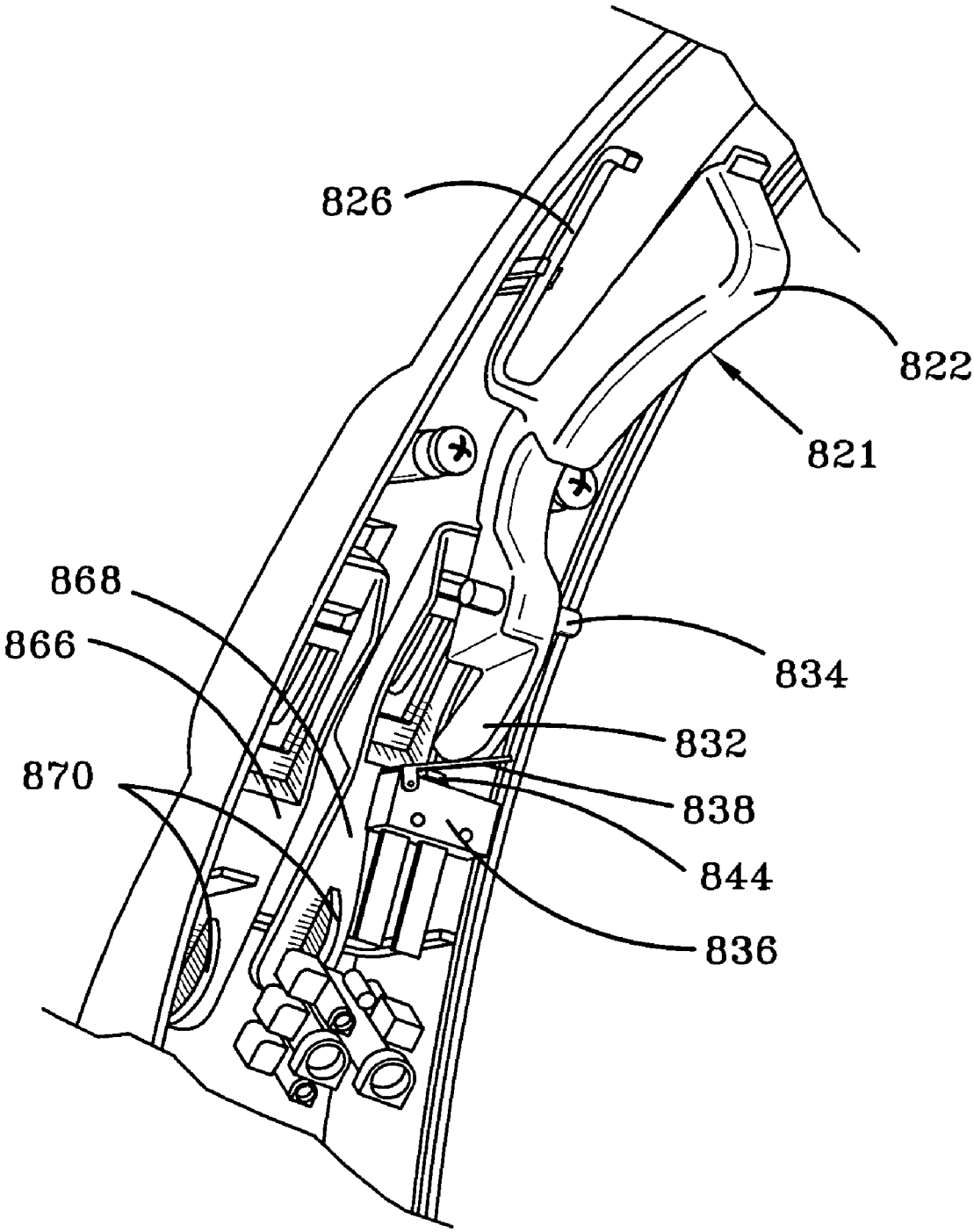
FIG. 22 is a fragmentary rear perspective view of an upper portion of the handle of FIG. 16 with portions cut away to show elements of the trigger switch, and actuating rods for the cleaning mode switch assembly.
Figure 23:
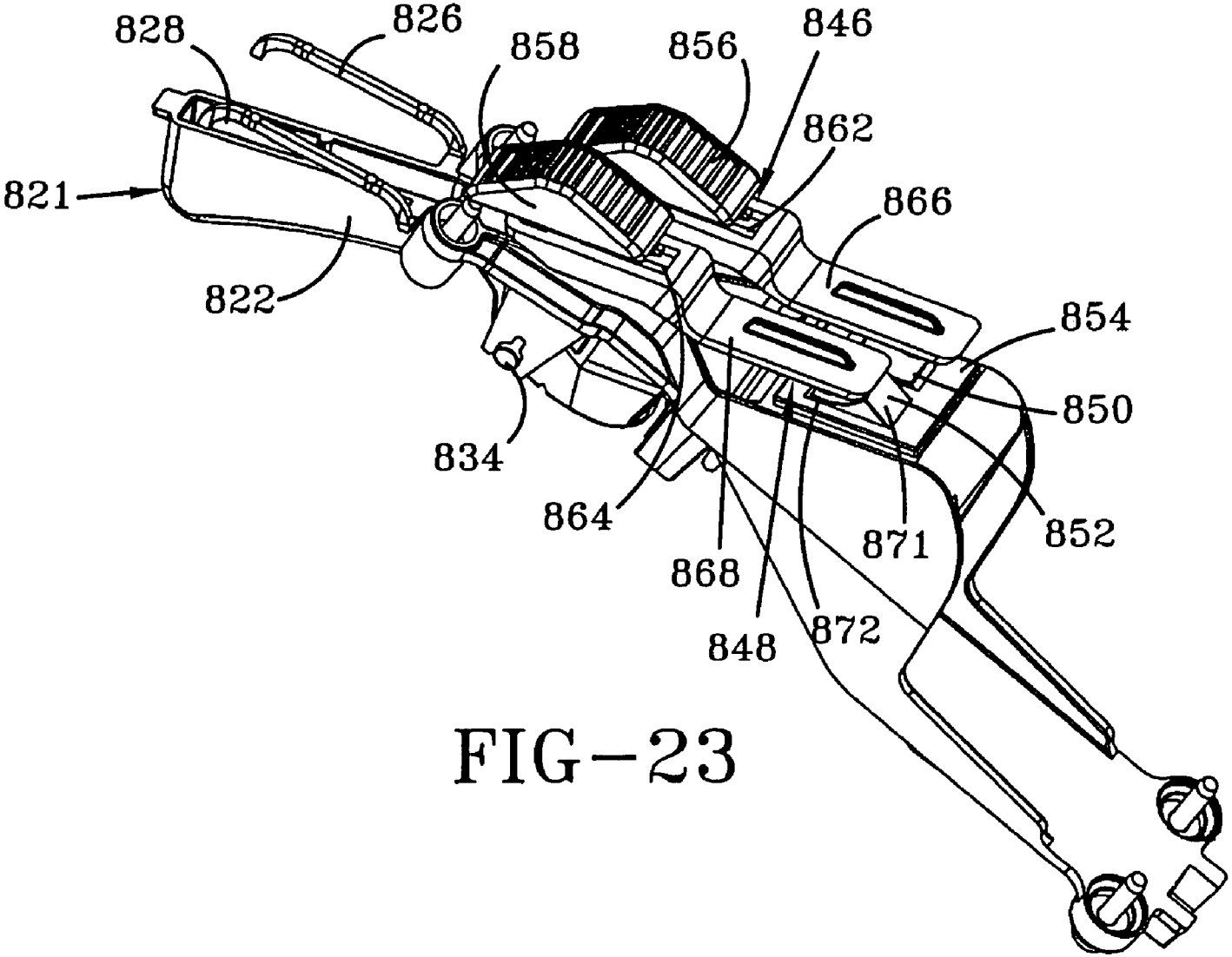
FIG. 23 is a fragmentary front rear perspective view of an upper portion of the handle of FIG. 16 with portions cut away to show the cleaning mode switch assembly and related parts.

Referring to FIGS. 22 and 23, a trigger switch 821 is used to dispense either mixed detergent and clean water or only clean water. The trigger switch 821 includes a trigger 822 pivotally connected to the upper portion of the handle 612 approximately near a closed looped hand grip 824 (FIG. 16) of the handle 612 at a pivot 834. Integrally molded onto the trigger 822 are two cantilever springs 826, 828 (FIG. 23), one on each lateral side thereof. The cantilever springs 826, 828 urge the trigger 822 outwardly or downwardly which places one of the selected shut off valves 800, 820 (FIG. 20) in the closed position. In particular as depicted in FIG. 22, an arm 830 having a curved end portion 832 extends downwardly from the pivot 834 of the trigger 822 terminating adjacent a micro switch 836 of the trigger switch 821. A lever arm 838 is connected to the micro switch 836 and extends over a spring-loaded push button 840 on the micro switch 836. When the upper portion of the trigger 822 is positioned downwardly, the curved end portion 832 is spaced from the lever arm 838.

Figure 24:
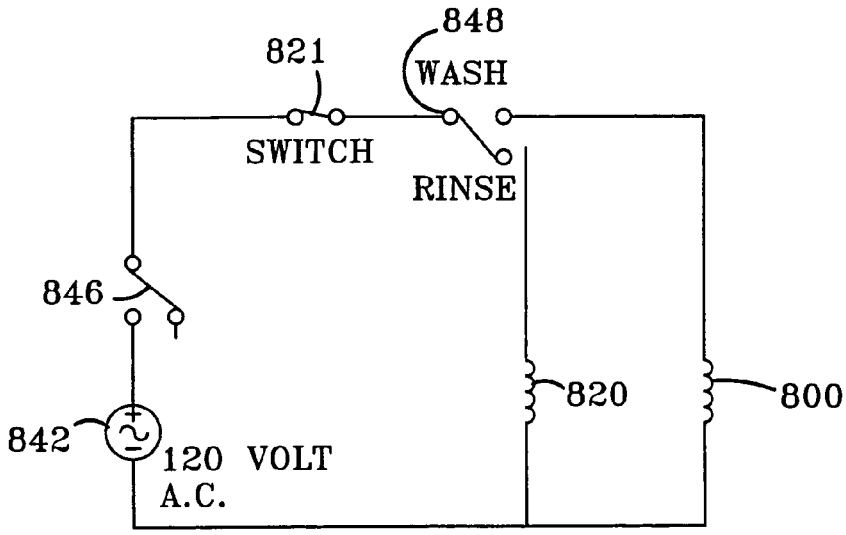
FIG. 24 is a schematic diagram showing the electrical circuit for the fluid distribution system used in the embodiment shown in FIG. 16.

In this position with reference to FIG. 24, the micro switch 836 opens the circuit between one of the solenoid shut off valves 800, 820 and the main power source 842, thereby deenergizing the selected valve 800 or 820 and closing it. When the upper portion of the trigger 822 is squeezed or depressed, the curved end portion 832 cams against the lever arm 838 such that the lever arm 838 depresses the push button 844 on the micro switch 836. Upon depression of the push button 844, the micro switch 836 closes the circuit as depicted in FIG. 24 between one of the solenoid shut off valves 800, 820 and the main power switch assembly 846 (FIG. 24). If the main power switch assembly 846 is switch on to connect the power source 842 to the selected solenoid shut off valve 800 or 820 and the trigger 822 is squeeze or depressed, the selected solenoid shut off valve energizes and opens.

A cleaning mode switch assembly 848 is connected between the micro switch 836 and the water and main solenoid shut off valves 800, 820 to select the mode of cleaning. As shown in FIG. 23, the cleaning mode switch assembly 848 and main power switch assembly 846 include respective rocker arms 850, 852 positioned adjacent each other and mounted in a module 854 which is mounted in the upper portion of the handle 612. The rocker arms 850, 852 are actuated by corresponding slide switches 856, 858 which are received in a recess 860 (FIG. 16) just below the handgrip 824. The slide switches 856, 858 snap connect into corresponding slots 862, 864 formed on the upper portions of respective actuating rods 866, 868. Cam portions 870 are formed on lower portions of the actuating rods 866, 868 for engaging their corresponding rocker arms 850, 852. When one of the slide switches 856, 858 is slid downwardly, the cam portion 870 depresses the lower portion 871 of the rocker arm 850 or 852 to switch it in one position. This action also raises the upper portion 872 of the rocker arm 850 or 852. Then, when the slide switch 856 or 858 is then slid upwardly back, the cam portion 870 depresses the upper portion of the rocker arm 850 or 852 to switch it in another position and thereby raise the lower portion 871 of the rocker arm 850 or 852.

In operation, a user slides the slide switch 856 of the main power switch assembly 846 down to electrically connect the power source 842 to the micro switch 836, suction motor (not shown), and pump 808, turning them on. Referring to FIG. 20, the pump 808 conducts the pressurized cleaning solution or clean water through a main supply tube 874 to a control valve 877 which selectively allows the liquid to flow to either the cleaning distributor 792 via supply tube 876 or a hand-held cleaning attachment (not shown) via a supply tube 878 and an opening 880 in the top of a suction nozzle 882. The cleaning liquid distributor 792 evenly distributes the cleaning liquid to each of the rotary scrub brushes 616. The scrub brushes 616 then spread the cleaning liquid onto the carpet (or bare floor), scrub the cleaning liquid into the carpet and dislodge embedded soil. Such a distributor 792 and scrub brushes 616 are substantially disclosed in commonly owned U.S. Pat. No. 5,867,857, the disclosure of which is hereby incorporated herein as of reference.

Referring to FIG. 16, as is commonly known, the carpet extractor 610 distributes cleaning solution to the carpeted surface and substantially simultaneously extracts it along with the dirt on the carpet in a continuous operation. In particular, soiled cleaning liquid is extracted from the carpet by the suction nozzle 882, which communicates with a recovery tank 884 (FIG. 10) via an air duct. A vacuum is created in the recovery tank 884 by a motor fan assembly (not shown) that draws air from the recovery tank 884 and exhausts the air to the external atmosphere in a well-known conventional manner. The recovery tank 884 includes an air and liquid separator (not shown), as is understood by one of skill in the art, for separating liquid from the air entering the recovery tank 884 and recovering the separated liquid in the tank 884.

If the wash cleaning mode is desired, the user slides the slide switch 858 of the cleaning mode switch assembly 848 upwardly to the upper end of the recess 860 to electrically connect the micro switch 836 (FIG. 24) to the main solenoid shut off valve 820 (FIG. 24). With reference to FIG. 20, the control valve 877 is positioned to direct the cleaning solution to the distributor 792. Then, the user squeezes the trigger 822 (FIG. 16) which opens the main solenoid shut off valve 820 to allow the cleaning solution composed of detergent mixed with clean water to flow to the distributor 792 and brushes 616, where it is distributed and scrubbed on the carpet. If rinsing is desired, the user slides the slide switch 858 of the cleaning mode switch assembly 848 downwardly to the lower end of the recess 860 to electrically connect the micro switch 836 to the water solenoid shut off valve 800. Then, the user squeezes the trigger 822 which opens the water solenoid shut off valve 800 to allow clean water from the clean water tank 620 to flow to the distributor 792 and brushes 616, where it is distributed and scrubbed into the carpet.

Figure 24A:
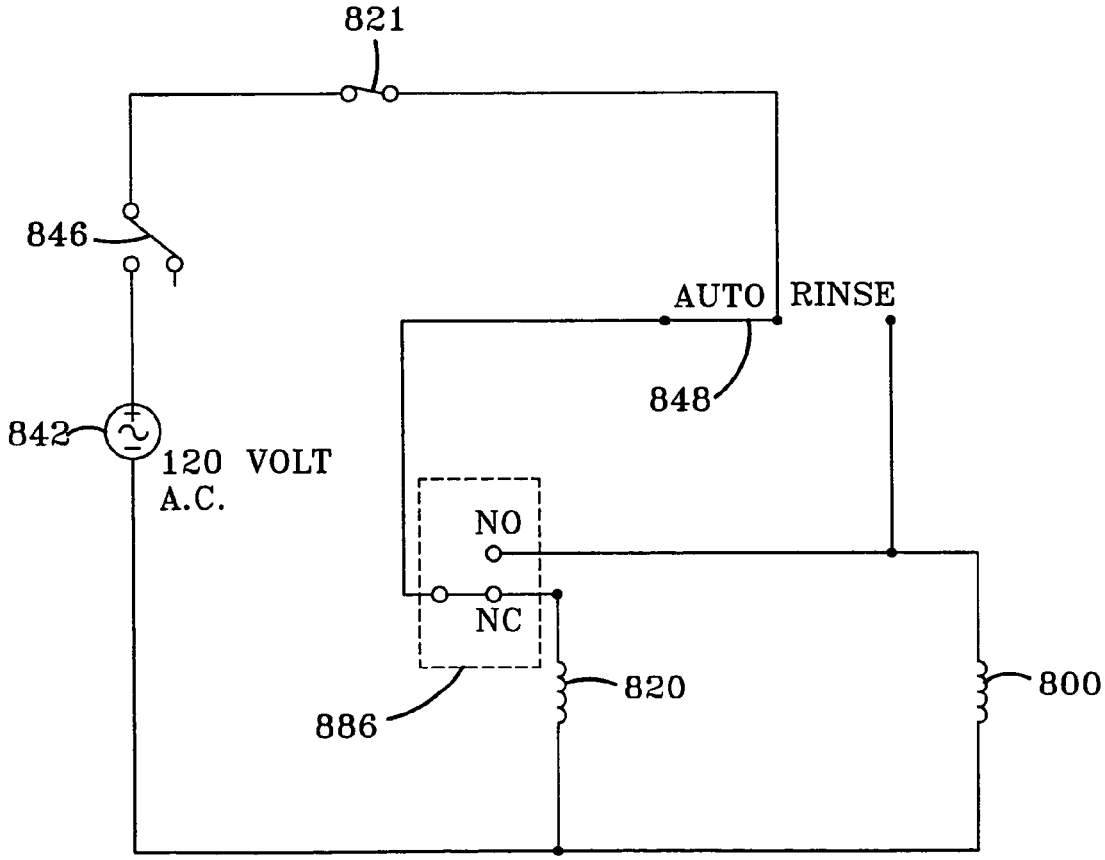
FIG. 24A is a schematic diagram showing another electrical circuit for the fluid distribution system used in the embodiment of FIG. 16 that automatically cleans the carpet or floor using one cleaning mode on the forward stroke of a cleaning cycle and another cleaning mode for the reverse stroke of the cleaning cycle.

FIG. 24A depicts an electrical schematic diagram of the distribution system of the carpet extractor 610 that automatically cleans the carpet or floor using one cleaning mode on the forward stroke of a cleaning cycle and another cleaning mode for the reverse stroke of the cleaning cycle. Components from the circuit shown in FIG. 24, which are identical in structure and have identical functions, will be identified by the same reference numbers for this circuit. In this circuit, a second micro switch 886 is connected between the water and main solenoid shut off valves 800, 820.

Figure 25:
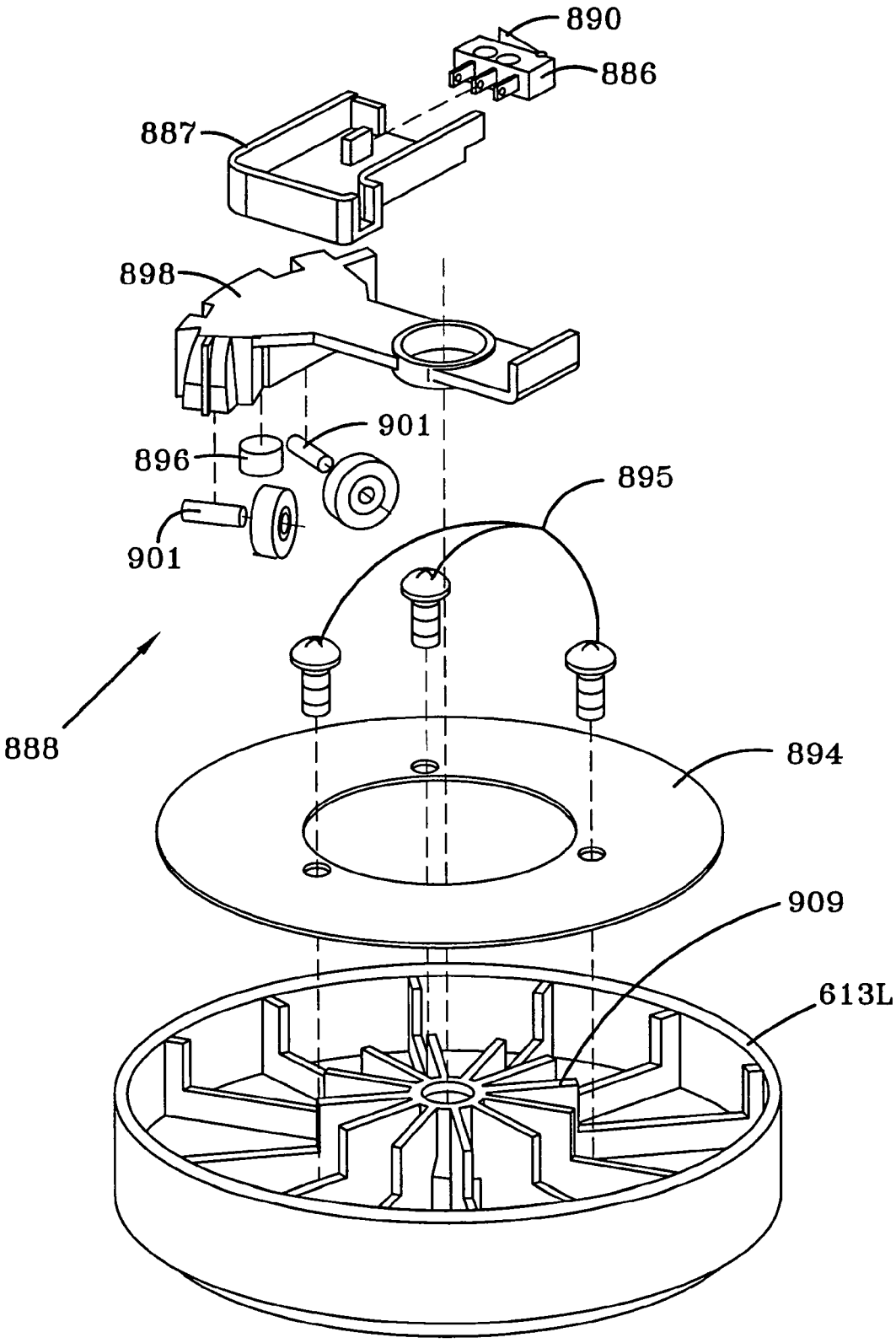
FIG. 25 is an exploded view of the wheel rotation activating assembly and left rear wheel of the embodiment shown in FIG. 16, which uses the electrical circuit of FIG. 24A.
Figure 26A:
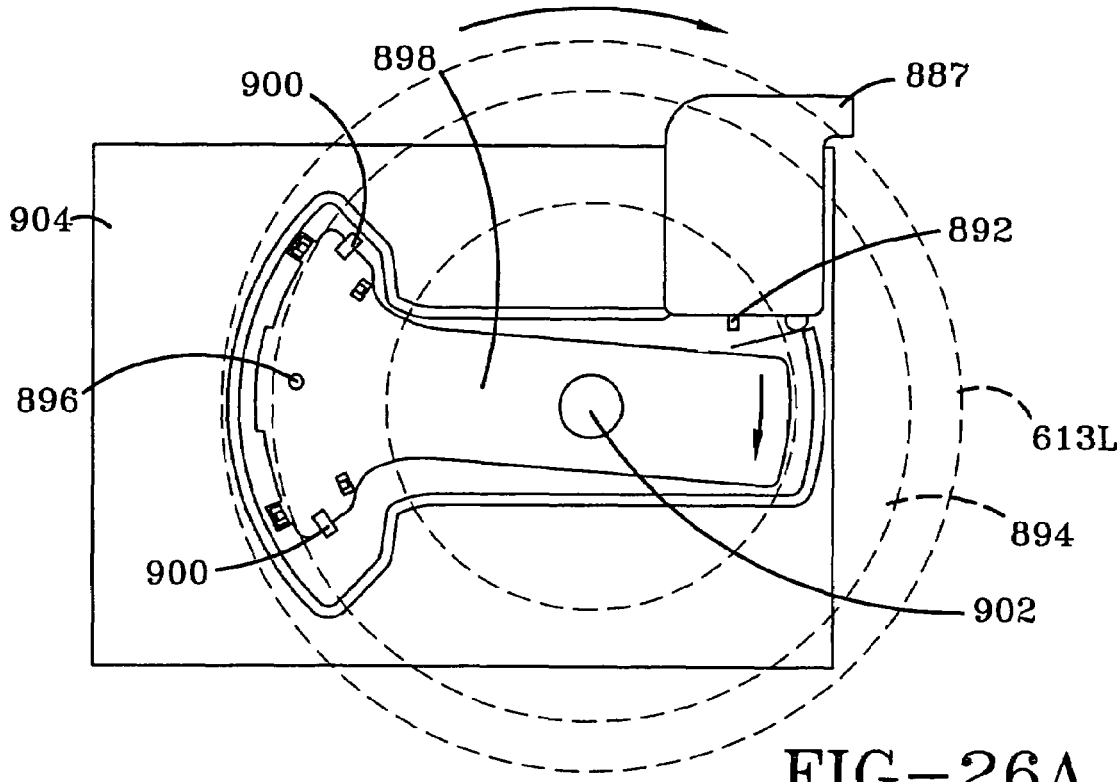
FIG. 26A is a partial left side view of the base of the carpet extractor of FIG. 16 showing the wheel rotation activating assembly of FIG. 25 operating to wash the carpet or floor during the forward stroke.
Figure 26B:
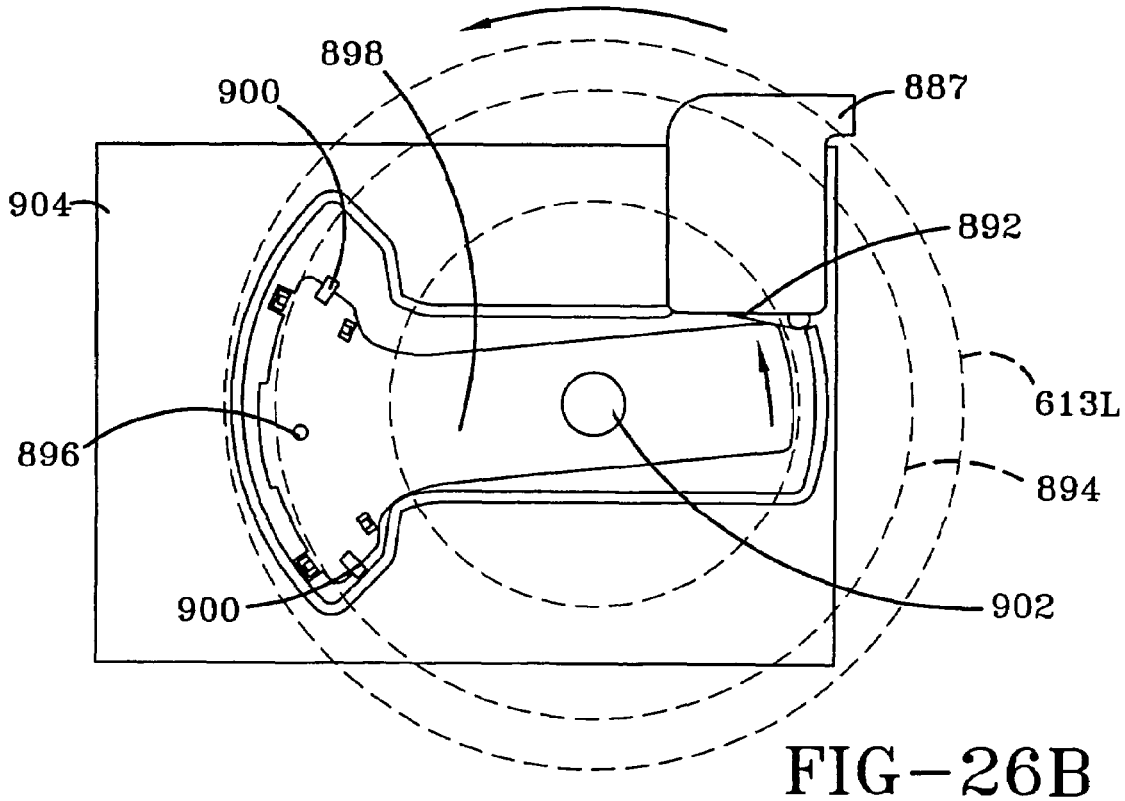
FIG. 26B is as a view similar to FIG. 26A but with the wheel rotation activating assembly being operated to rinse the carpet or floor during the reverse stroke.

As depicted in FIG. 25, the micro switch 886 is part of a wheel rotation activating assembly 888 associated with the rear wheel 613L on the left side of the foot portion 614 9FIG. 16). A lever arm 890 is connected to the micro switch 886 and extends over a spring-loaded push button 892 (FIGS. 26A and 26B) on the micro switch 886. A micro switch cover 887 covers the micro switch 886 and this assembly is mounted to the main body or frame 904 (FIGS. 26A and 26B) of the foot portion 614. The wheel rotation activating assembly 888 further includes a magnet 896 secured to an actuation lever 898 positioned spacedly adjacent a steel wheel disc 894 mounted to the rear extractor wheel 613L by screws 895. As depicted in FIGS. 26A and 26B, rollers 900, having axles 901 (FIG. 25) extending there through, are rotatably mounted to the actuation lever 898. The rollers 900 ride on the wheel disc 894 to ensure clearance between the magnet 896 and wheel disc 896. The axle 902 of the rear extractor wheel 613 slidably extends through the actuation lever 898 such that the actuation lever 898 is allowed to pivot or rotate around it. The actuation lever 898 is further positioned in a recess of the main body 904 adjacent the micro switch 886. The magnets 896 follow the direction of rotation of the wheel 613 due to the magnetic attraction between them, thereby causing the actuation lever 898 to rotate.

Figure 28:
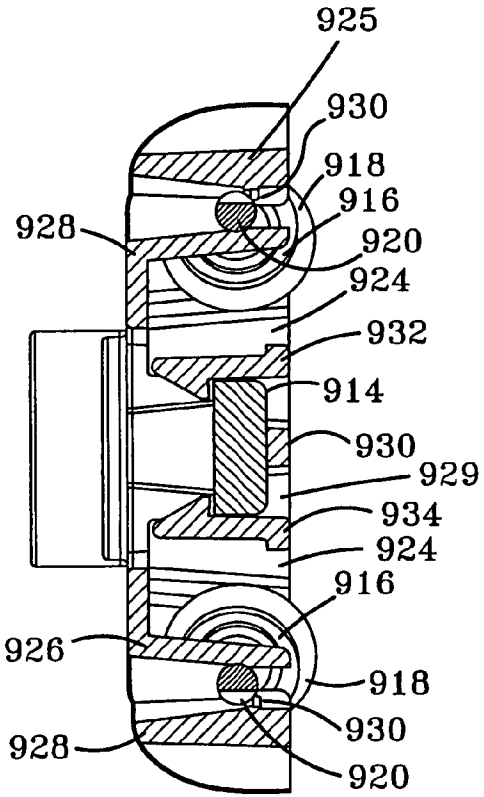
FIG. 28 is a sectional view taken along line 28-28 of FIG. 27.
Figure 27:
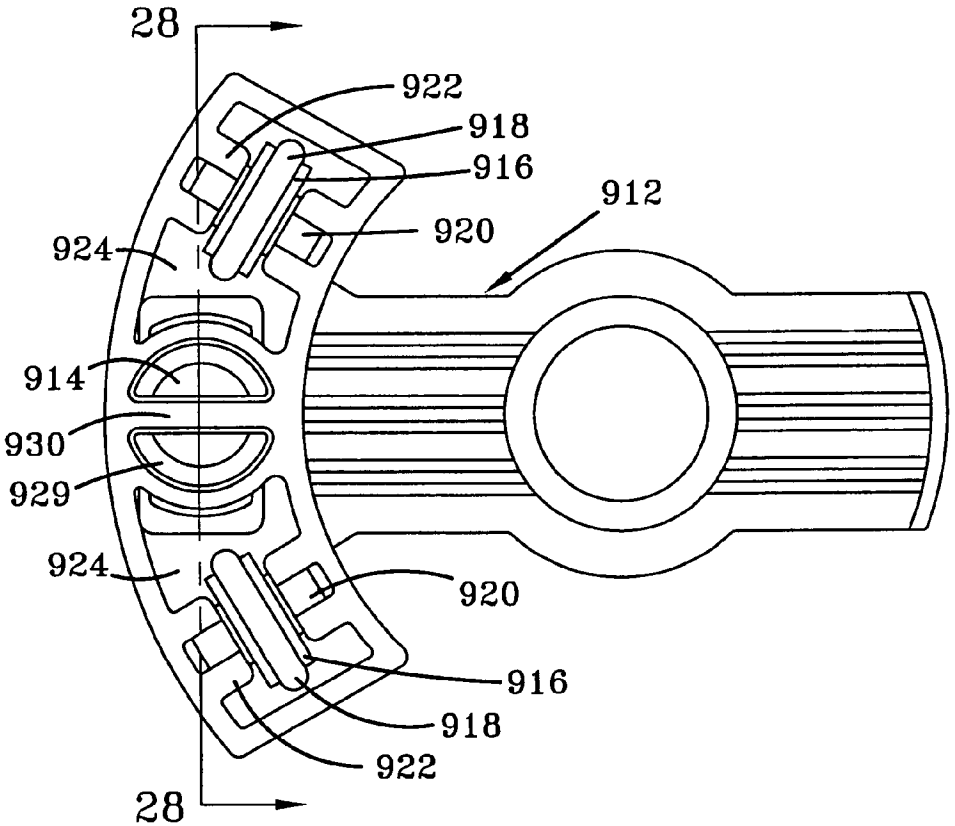
FIG. 27 is a side elevational view of another actuator lever and related parts used on the wheel rotation activating assembly of FIG. 25.

Alternatively, FIGS. 27 and 28 depict another actuation lever 912 with accompanying magnet 914 and rollers 916. These rollers 900 include rubber tires 918 secured around them and axles 920 extending through the center. The rollers 916 with the tires 918 are rotatably positioned in recesses 924 formed in the side 926 of the actuator lever 912 opposing the wheel disc 894. The axles 920 are snap connected into u-shaped holders 922 formed in the side of the actuator lever 912 opposing the wheel disc 894.

In particular with reference to FIG. 28, the axles are slidably inserted between elastic legs 926, 928 of the holder 922, engaging a pair of opposing ledges or barbs 930 formed on the legs 926, 928 which cause the legs 926, 928 to deflect outwardly to allow the holder to pass through. After the holder is inserted beyond the barbs, the legs retract back so that the barbs secure the axles within the holder. The magnet 914 is seated into an opening 929 of the actuation lever 898 and held securely in place by elastic catches 932, 934 engaging it against a rib 930 extending across the center of the opening 929.

When the carpet extractor unit 610 (FIG. 16) goes forward as indicated by the rotation of the rear wheel 613L in FIG. 26A, the actuation lever 898 and lever arm 890 are disengaged from the push button 892 of the micro switch 886. In this position, the micro switch 886 electrically connects the power source 842 to the main solenoid shut off valve 820, depicted in FIG. 24A. Thus, when the trigger 822 is squeezed, the main solenoid shut off valve 820 energizes and opens, thereby allowing water mixed with detergent to be supplied to the distributor 792 or hand-held cleaning attachment. When the extractor unit 610 moves rearward as indicated by the rotation of the rear wheel 613L in FIG. 26B, the actuation lever 898 engages the lever arm 890 which depresses the push button 892. This causes the micro switch 886 to electrically connect the power source 842 to the water solenoid shut off valve 800 as shown in FIG. 24A, thereby energizing it to open. Also, in this position, the micro switch 886 disconnects the power source 842 to main solenoid shut off valve 820, thereby deenergizing it. Thus, clean water is automatically distributed on the floor surface.

Figure 29:
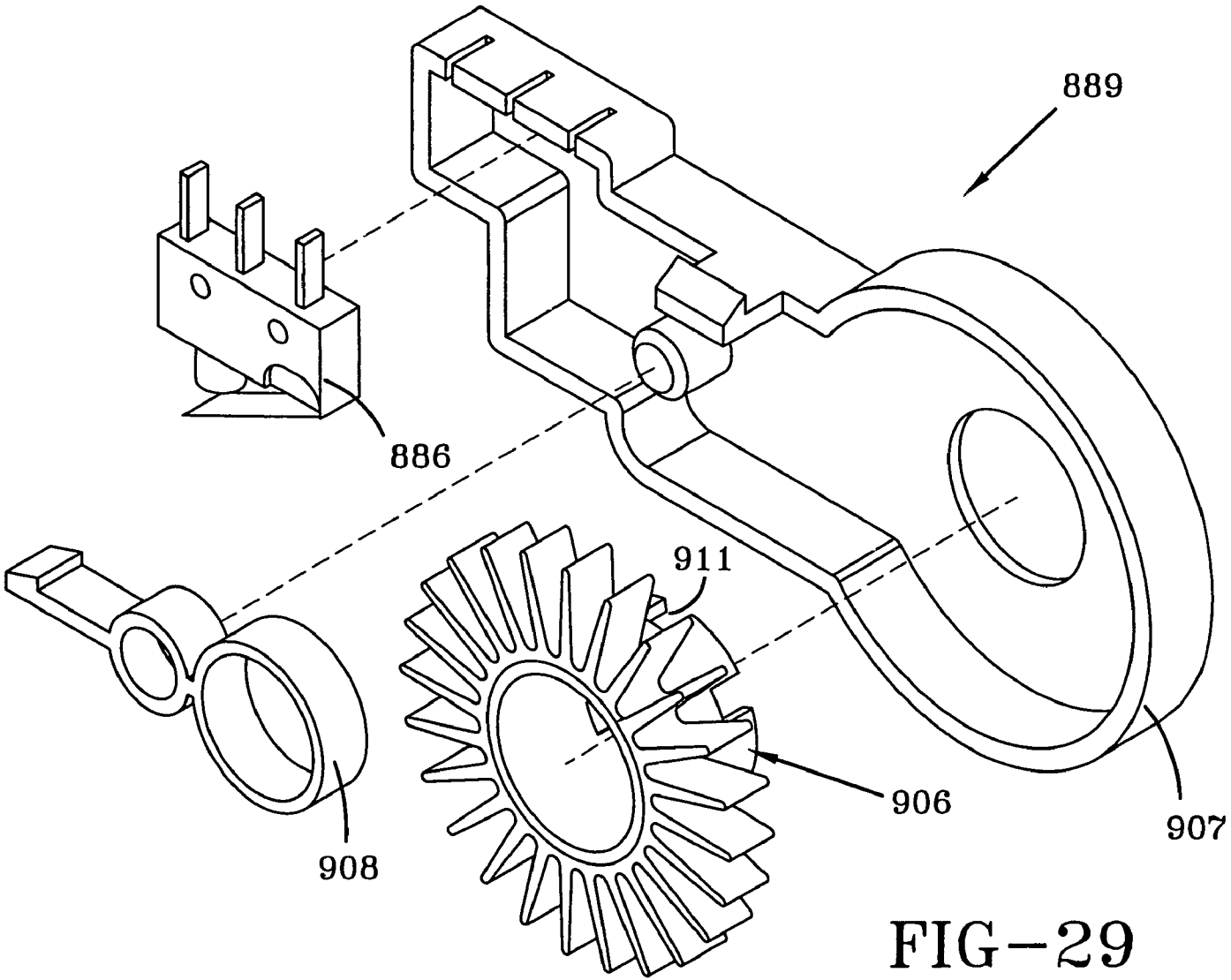
FIG. 29 is an exploded view of another version of a wheel rotation activating assembly used in the embodiment shown in FIG. 16.
Figure 30A:
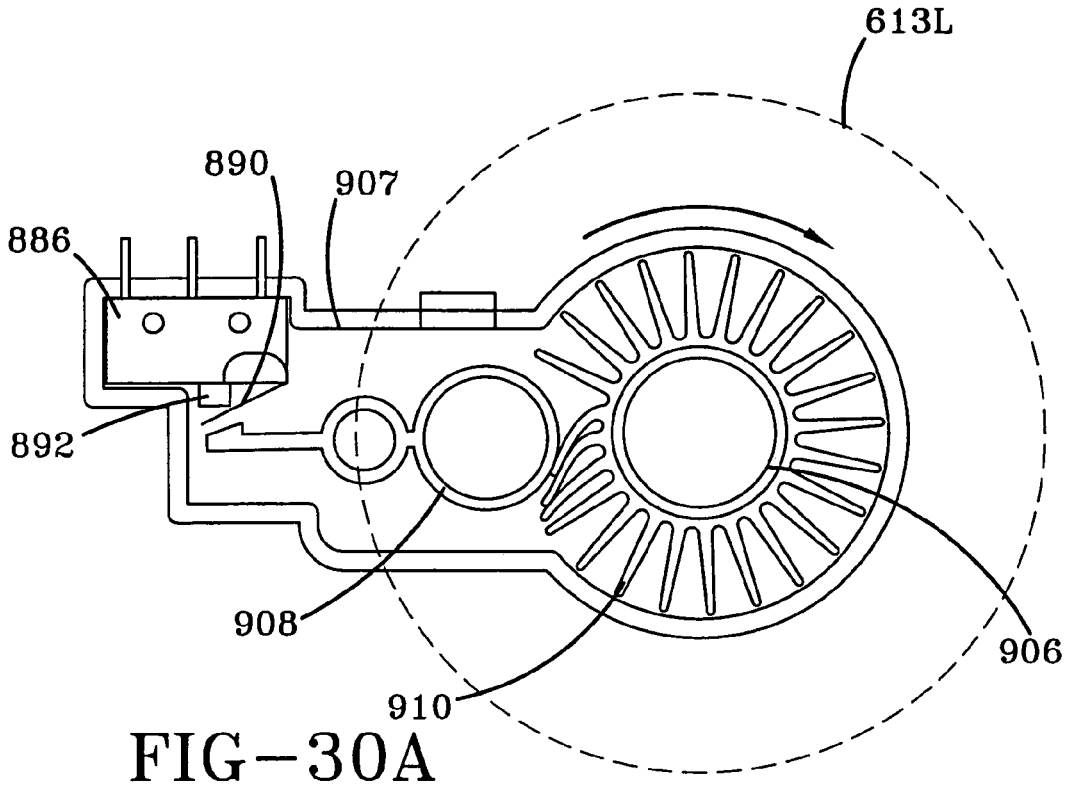
FIG. 30A is a partial left side view of the base of the carpet extractor of FIG. 16 showing the wheel rotation activating assembly of FIG. 29 operating to wash the carpet or floor during the forward stroke.
Figure 30B:
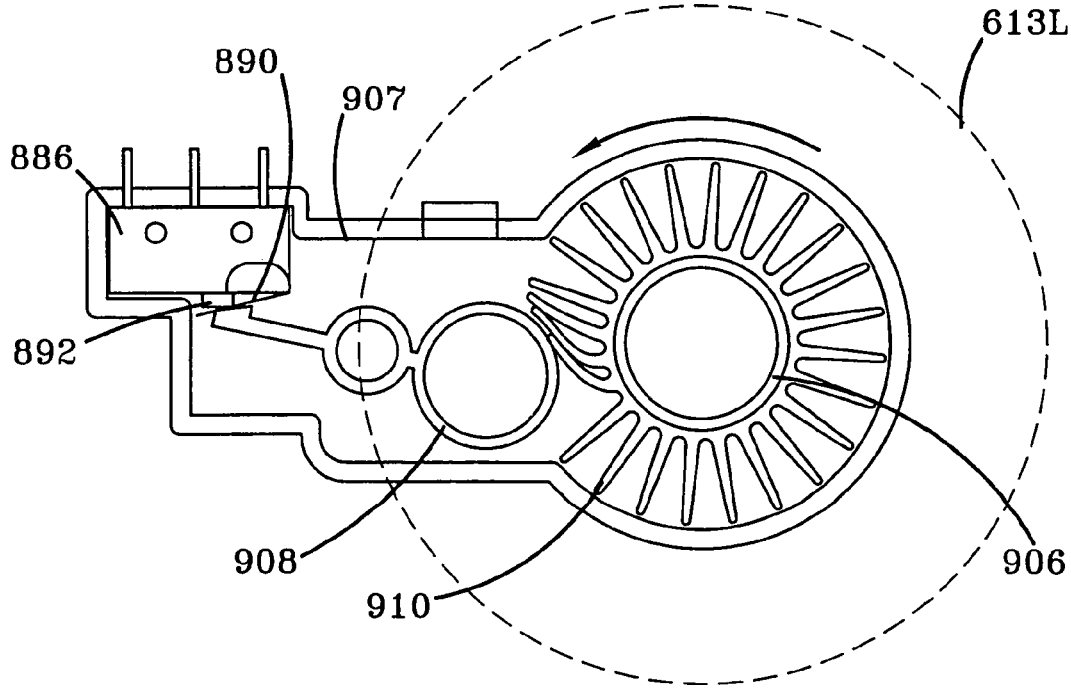
FIG. 30B is a view similar to FIG. 26A but with the wheel rotation activating assembly being operated to rinse the carpet or floor during the reverse stroke.

Another wheel rotation activating assembly 889 is shown in FIGS. 29, 30A, and 30B. It comprises a paddle wheel 906 that rotates an actuation lever 908 to activate the micro switch 886. The paddle wheel 906 and actuation lever 908 are roatably mounted in a housing 907 and the micro switch is fixedly secured to the housing 907 as best seen in FIGS. 30A and 30B. This assembly is mounted to the foot portion 614 (FIG. 16) of the extractor unit 610. The paddle wheel 906 has grooves 911 (FIG. 29) which frictionally engage ribs 909 (FIG. 25) on the left rear extractor wheel 613L (FIG. 25), securing it thereto. As shown in FIG. 30A, when the extractor unit 610 (FIG. 16) moves forward, the paddle wheel 906 rotates in the direction of the arrow such that the elastic paddles 910 on the paddle wheel 906 strike the actuation lever 908 causing it to rotate away from the lever arm 890, disengaging it from the push button 892 of the micro switch 886. As depicted in FIG. 30B, when the extractor unit 610 is moves rearward, the paddle wheel 906 rotates in the direction of the arrow such that the paddles 910 on the paddle wheel 906 strike the actuation lever 908 causing it to rotate and engage the lever arm 890 which depresses the push button 892 on the micro switch 886.

Figure 32:
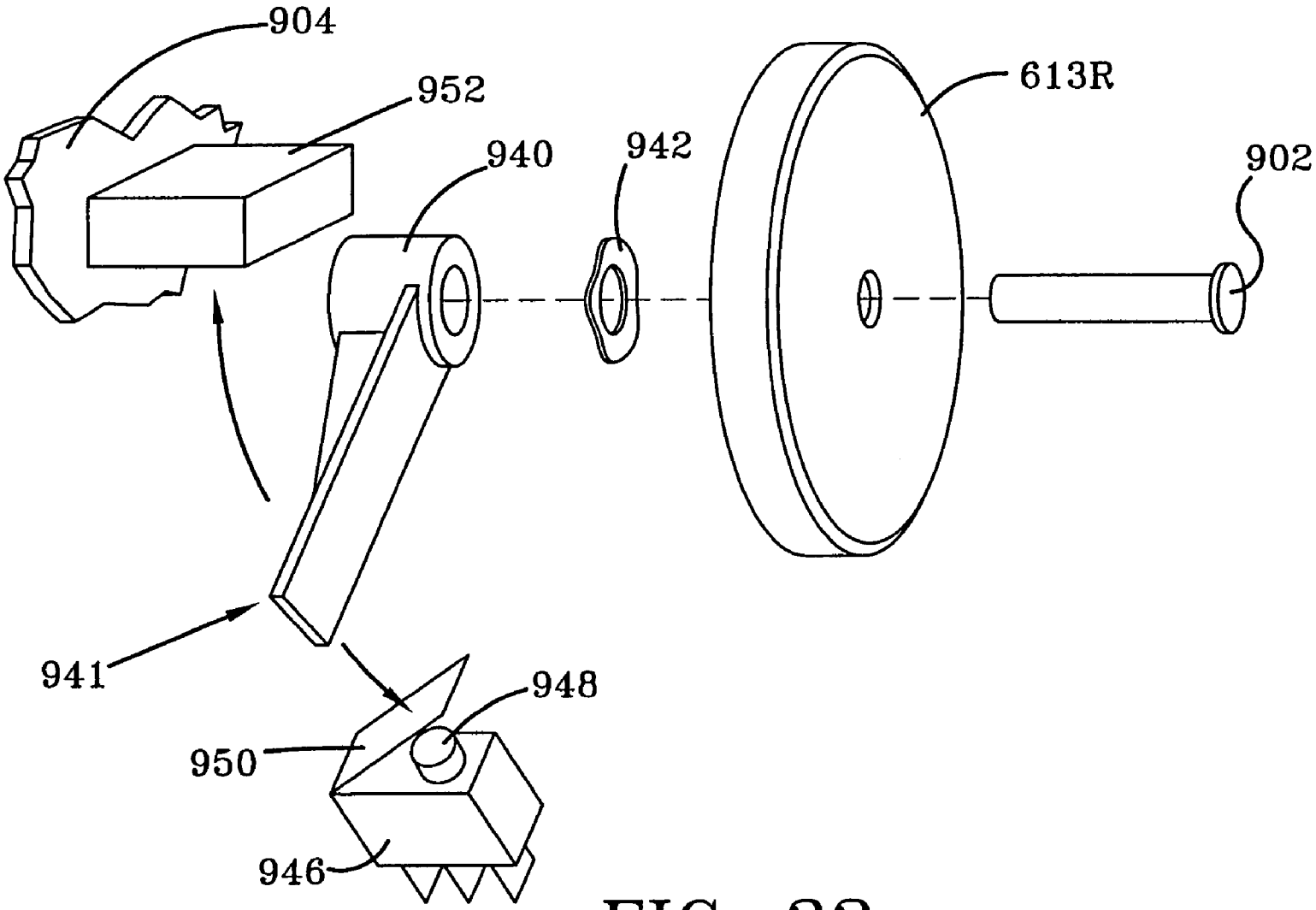
FIG. 32 is an exploded view of another version of a wheel rotation activating assembly and related elements used on the right rear wheel in the embodiment shown in FIG. 16.
Figure 33A:
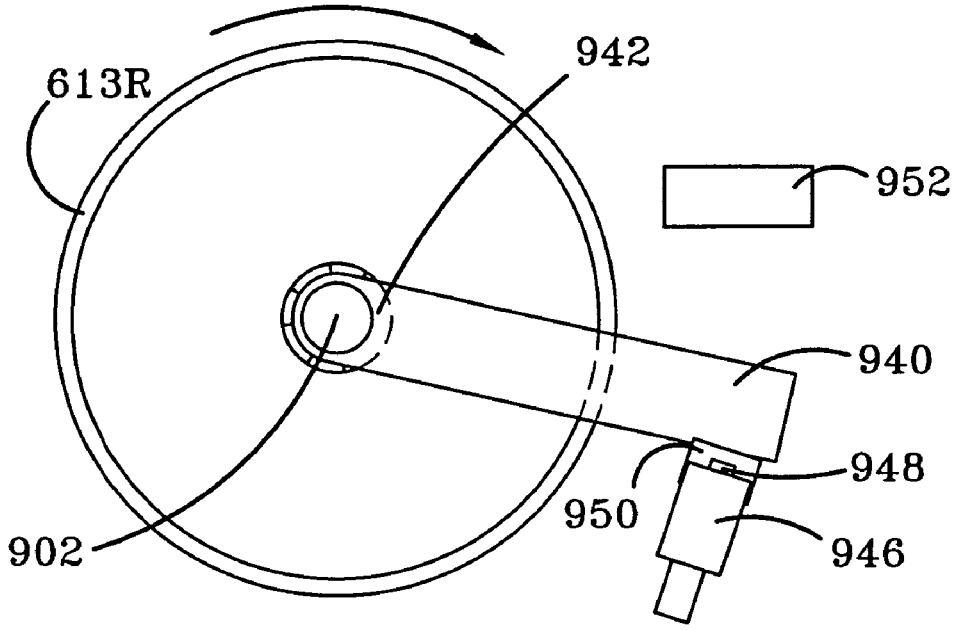
FIG. 33A is a partial left side view of FIG. 32 showing the wheel rotation activating assembly operating to wash the carpet or floor during the forward strike.
Figure 33B:
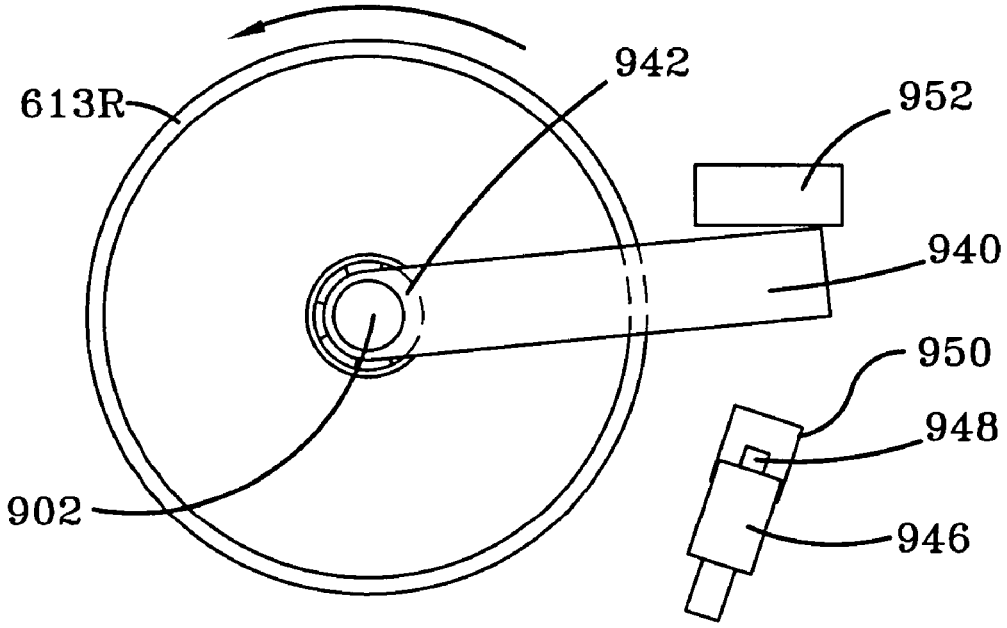
FIG. 33B is a view similar to FIG. 33B but with the wheel rotation activating assembly being operated to rinse the carpet or floor during the reverse stroke.

Still another wheel rotation activating assembly 941 is shown in FIGS. 32, 33A and 33B. The wheel rotation activating assembly 941 comprises an actuator lever 940, wave washer 942, and micro switch 946. In this assembly, the micro switch 946 is designed to electrically connect the power source 842 to the main solenoid shut off valve 820 (FIG. 24A) for washing, when its push button 948 is depressed and to electrically connect the power source 842 to the water solenoid shut off valve 800, when the push button 948 is not depressed. The axle 902 extends through the wave washer 942 and actuator lever 940. The actuator lever 940 rotates with the right rear wheel 613R due to friction generated by the wave washer 942. When the extractor unit 610 moves forward as shown in FIG. 33A by the arrow indicating the direction of the wheel rotation, the actuator lever 940 rotates to engage the lever arm 950 and depress the push button 948 on the micro switch 946. When the extractor unit 610 (FIG. 16) moves rearward as shown in FIG. 33B by the arrow indicating the direction of the wheel rotation, the actuator lever 940 moves away from the micro switch 946 disengaging the lever arm 950 from the push button 948 and traveling until it strikes a stop 952 attached on the main body 904 (FIG. 32). Upon engaging either the stop 952 or micro switch 946, the actuator lever 940 slips against the wheel hub, allowing the rear wheel 613R to rotate and therefore allowing the unit to continue moving in the forward or rearward direction.

If rinsing is desirable on both the forward and reverse strokes the user slides the slide switch 858 of the cleaning mode switch assembly 848 downwardly to the lower end of the recess 860 to electrically connect the micro switch 886 to the water solenoid shut off valve 800. Then, the user squeezes the trigger 822 which opens the water solenoid shut off valve 800 to allow clean water from the clean water tank 620 to flow to the distributor 792 and brushes 616, where it is distributed and scrubbed into the carpet. Alternatively, if washing is desired on both the forward and reverse strokes, a three position cleaning mode switch assembly could be used instead of the two position cleaning mode switch assembly with the third position being directly connected to the main solenoid shut off valve 820 bypassing the second micro switch 886 of the wheel rotating activating assembly 888.

By incorporating a rinse application as shown in the embodiments, a higher concentration of detergent in the cleaning fluid, generally two or more times as much as the clean water, can be used to wash the carpet during the first forward stroke, since the rinse application will rinse or remove the detergent residue not extracted. In particular, the carpet extractor will distribute the cleaning solution having the high detergent concentration on the forward stroke as it substantially and simultaneously extracts it along with the dirt on the carpet in a continuous operation. Then, the carpet extractor will distribute the cleaning solution having the clean water on the reverse stroke to rinse the detergent residue not extracted as the carpet extractor substantially and simultaneously extracts it along with the dirt on the carpet in a continuous operation. Thus, cleaning performance is improved.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto. For example, clean water could be applied on the forward stroke and detergent solution on the reverse stroke. Also, a certain liquid might be added to the clean water or be used alone to improve the rinsing operation.

In view of the above, it is intended that the present invention not be limited by the preceding disclosure of the embodiments, but rather be limited only by the appended claims.

We claim:

1. A surface cleaning apparatus having one or more operational features, comprising:

a suction nozzle for performing surface cleaning;

a handle having a first end operatively connected to the suction nozzle and a second end;

a handle portion slidably mounted to said second end of said handle;

a hall effect sensor located in proximity to the handle portion; and a control circuit operatively connected to said one or more operational features to control said one or more operational features based upon at least one signal;

wherein said handle portion slidably moves in a relative linear motion in relation to the hall effect sensor such that the relative linear motion causes the hall effect sensor to generate said at least one signal provided to said control circuit.

2. The apparatus of claim 1, wherein said control circuit includes a microprocessor.

3. The apparatus of claim 1, wherein said handle portion moves linearly in an up and down direction.

4. The apparatus of claim 1, wherein said handle portion includes a magnet located in proximity of the hall effect sensor to induce the hall effect sensor to generate said at least one signal.

5. The apparatus of claim 1, wherein said one or more operational features include a pump.

6. The surface cleaning apparatus of claim 1, wherein said magnet has a north pole, wherein upon movement of said handle near said north pole, said hall effect sensor is adapted to generate a high signal; and wherein upon receiving said high signal said control circuit is adapted to cause the surface cleaning apparatus to operate in a first mode.

7. The surface cleaning apparatus of claim 6, wherein upon movement of said handle away from said north pole, said hall effect sensor is adapted to generate a low signal; and wherein upon receiving said low signal said control circuit is adapted to cause the surface cleaning apparatus to operate in a second mode.

8. The surface cleaning apparatus of claim 7, wherein upon detecting a high signal from said hall effect sensor after receiving a first high signal and a low signal, said control circuit is adapted to operate the surface cleaning apparatus in a third mode.

9. A method of controlling one or more operational features of a surface cleaning apparatus, comprised of the steps of providing a suction nozzle for performing surface cleaning;

providing a handle having a first end operatively connected to the suction nozzle and a second end;

providing an electric motor;

providing at least one drive wheel operatively connected to the electric motor;

providing a handle portion slidably attached to the second end of said handle;

providing a hall effect sensor located in the proximity of said handle portion;

providing a control circuit operatively connected to said electric motor to control said electric motor based upon at least one signal; and moving said handle portion in relation to said second end of said handle such that the relative linear movement causes the hall effect sensor to generate said at least one signal provided to said control circuit.

10. A surface cleaning apparatus having one or more operational features, comprising:

a suction nozzle for performing surface cleaning;

a handle having a first end operatively connected to the suction nozzle and a second end;

a handle portion slidably mounted to said second end of said handle;

a hall effect sensor located in proximity to the handle portion; and a control circuit operatively connected to said one or more operational features to control said one or more operational features based upon at least one signal;

wherein said handle portion slidably moves in relative linear motion in relation to the hall effect sensor such that the relative linear motion causes the hall effect sensor to generate said at least one signal provided to said control circuit;

wherein at least one of the operational features is the flow of liquid.

11. The surface cleaning apparatus of claim 10 further comprising a clean water supply tank and a detergent supply tank, wherein said control circuit is operatively connected to the supply tanks to control the flow of fluid therefrom, wherein upon receiving a selected signal from the hall effect sensor, the control circuit allows liquid to flow from at least one of the supply tanks.

* * * * *